US008720160B1

(12) United States Patent
Cooper

(10) Patent No.: US 8,720,160 B1
(45) Date of Patent: May 13, 2014

(54) PROCESS FOR FORMING CONCRETE WALLS AND OTHER VERTICALLY POSITIONED SHAPES

(76) Inventor: Alan Brian Cooper, Solvang, CA (US)

( * ) Notice: Subject to any disclaimer, the term of this patent is extended or adjusted under 35 U.S.C. 154(b) by 331 days.

(21) Appl. No.: 13/232,881

(22) Filed: Sep. 14, 2011

(51) Int. Cl.

| | |
|---|---|
| ***E04B 1/00*** | (2006.01) |
| ***E04G 23/00*** | (2006.01) |
| ***E04B 2/86*** | (2006.01) |
| ***E04C 5/16*** | (2006.01) |

(52) U.S. Cl.

CPC ..... *E04B 2/8647* (2013.01); *E04B 2/8635* (2013.01); *E04B 2/8617* (2013.01); *E04B 2/8652* (2013.01); *E04B 2/8629* (2013.01); *E04C 5/16* (2013.01)

USPC ..... 52/745.12

(58) Field of Classification Search

CPC ..... E04B 2002/867; E04B 2/8647; E04B 2/8635; E04B 2/8617; E04B 2/8652; E04B 2/8629; E04C 5/168

USPC ..... 52/741.1, 741.13, 742.1, 742.13, 52/742.14, 742.15, 745.05, 745.09, 52/745.12, 415, 426, 439, 309.11, 309.12, 52/431, 432

See application file for complete search history.

(56) References Cited

U.S. PATENT DOCUMENTS

| | | | | | |
|---|---|---|---|---|---|
| 1,755,960 | A | * | 4/1930 | Kohler | 249/44 |
| 3,238,684 | A | * | 3/1966 | Wood | 52/379 |
| 3,899,259 | A | * | 8/1975 | Boice | 403/169 |
| 4,138,833 | A | * | 2/1979 | Townend | 52/745.02 |
| 4,234,156 | A | * | 11/1980 | Wepf | 249/40 |
| 4,320,606 | A | * | 3/1982 | GangaRao | 52/125.5 |
| 4,864,792 | A | * | 9/1989 | Andre et al. | 52/426 |
| 4,885,888 | A | | 12/1989 | Young | |
| 4,901,494 | A | * | 2/1990 | Miller et al. | 52/309.12 |
| 4,972,646 | A | * | 11/1990 | Miller et al. | 52/293.1 |
| 5,140,794 | A | * | 8/1992 | Miller | 52/309.12 |
| 5,431,368 | A | * | 7/1995 | Wilde | 249/213 |
| 5,570,552 | A | * | 11/1996 | Nehring | 52/426 |
| 5,771,648 | A | * | 6/1998 | Miller et al. | 52/309.7 |
| 6,131,365 | A | * | 10/2000 | Crockett | 52/794.1 |
| 6,336,611 | B1 | * | 1/2002 | Collinucci | 244/129.4 |
| 6,622,452 | B2 | * | 9/2003 | Alvaro | 52/742.14 |
| 6,634,831 | B2 | * | 10/2003 | Canteri | 405/264 |
| 6,718,722 | B2 | * | 4/2004 | Worrell et al. | 52/741.13 |
| 6,722,099 | B2 | * | 4/2004 | Gilbert et al. | 52/745.09 |
| 6,880,304 | B1 | * | 4/2005 | Budge | 52/426 |
| 6,922,962 | B2 | | 8/2005 | Schmidt | |
| 6,935,081 | B2 | | 8/2005 | Dunn et al. | |
| 7,024,833 | B1 | | 4/2006 | Rice | |
| 7,082,731 | B2 | * | 8/2006 | Patz et al. | 52/426 |
| 7,337,591 | B2 | * | 3/2008 | Molina | 53/426 |
| 7,415,804 | B2 | | 8/2008 | Coombs et al. | |
| 7,516,589 | B2 | * | 4/2009 | Messiqua et al. | 52/646 |
| 7,614,199 | B2 | * | 11/2009 | Smalley, III | 52/741.13 |
| 7,735,292 | B2 | * | 6/2010 | Massie | 52/742.14 |
| 7,762,033 | B2 | * | 7/2010 | Scott et al. | 52/425 |
| 7,765,759 | B2 | | 8/2010 | Au et al. | |

(Continued)

*Primary Examiner* — Mark Wendell
*Assistant Examiner* — Keith Minter
(74) *Attorney, Agent, or Firm* — William Bodnar

(57) ABSTRACT

A method for forming a vertical wall cavity above a raised foundation having multiple vertical rigid re-enforcement members linearly arrayed and protruding therefrom, the method utilizing spacers secured to re-enforcement members positioned between opposing wall formation panels secured in position, and semi-annular dams supported by center and edge dam supports, the cavity bounded by wall formation panels on two opposing sides and the dams and dam supports on the other two opposing sides.

20 Claims, 28 Drawing Sheets

(56) References Cited

U.S. PATENT DOCUMENTS

| | | | | |
|---|---|---|---|---|
| 8,127,509 | B2 * | 3/2012 | Propst | 52/309.12 |
| 8,191,331 | B2 * | 6/2012 | Little, Jr. | 52/742.1 |
| 8,348,224 | B2 * | 1/2013 | McDonagh | 249/216 |
| 2004/0148889 | A1 * | 8/2004 | Bibee et al. | 52/481.1 |
| 2007/0044405 | A1 | 3/2007 | Straub et al. | |
| 2008/0022619 | A1 | 1/2008 | Scherrer | |
| 2008/0110118 | A1 * | 5/2008 | Molina | 52/379 |
| 2008/0216445 | A1 * | 9/2008 | Langer | 52/745.09 |
| 2008/0313991 | A1 | 12/2008 | Chouinard | |
| 2009/0056258 | A1 | 3/2009 | Currier | |
| 2010/0051779 | A1 * | 3/2010 | McCary | 249/33 |
| 2011/0099927 | A1 * | 5/2011 | Garcia Viar | 52/220.2 |
| 2011/0131911 | A1 * | 6/2011 | McDonagh | 52/426 |
| 2011/0239566 | A1 * | 10/2011 | Ciuperca et al. | 52/259 |
| 2011/0247286 | A1 * | 10/2011 | Houle | 52/404.1 |
| 2011/0272556 | A1 * | 11/2011 | Lin | 249/190 |
| 2011/0302865 | A1 * | 12/2011 | Kliegle et al. | 52/483.1 |
| 2012/0073229 | A1 * | 3/2012 | Castonguay et al. | 52/426 |
| 2012/0131870 | A1 * | 5/2012 | deMaere | 52/309.4 |
| 2012/0174518 | A1 * | 7/2012 | Litaize | 52/582.1 |
| 2012/0233950 | A1 * | 9/2012 | Carr et al. | 52/426 |
| 2012/0247046 | A1 * | 10/2012 | Jewett et al. | 52/426 |
| 2013/0014458 | A1 * | 1/2013 | Boydstun et al. | 52/274 |
| 2013/0074432 | A1 * | 3/2013 | Ciuperca | 52/309.4 |
| 2013/0081353 | A1 * | 4/2013 | Jensen | 52/742.1 |

* cited by examiner

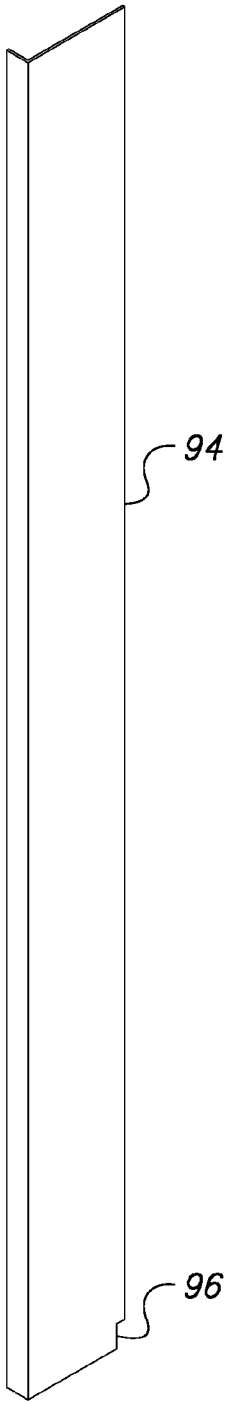
FIG. 18A
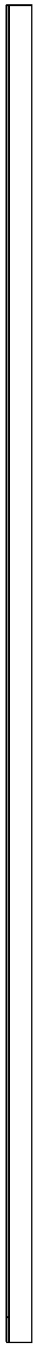
FIG. 18B
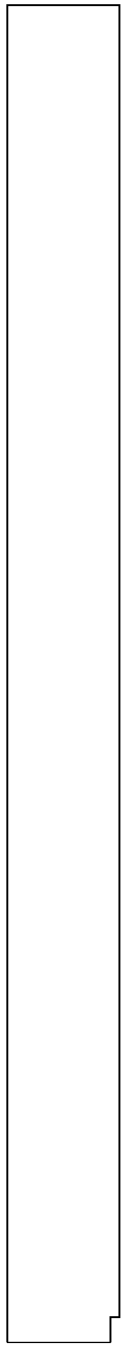
FIG. 18C
FIG. 18D

PROCESS FOR FORMING CONCRETE WALLS AND OTHER VERTICALLY POSITIONED SHAPES

CROSS REFERENCE TO RELATED APPLICATIONS

None.

FIELD OF THE INVENTION

The present invention relates to a process for forming concrete walls and like structures.

BACKGROUND OF THE INVENTION

Concrete formation involves numerous processes each of which presents unique problems. These processes can include a) placement of the concrete (concrete fall or drop resulting in separation of cement paste from aggregates), b) containment of poured concrete (boundaries limiting concrete flow), c) vibration of the concrete (improper or incomplete consolidation). Inadequacies in one of these processes can lead to formwork failure (from concrete hydraulic pressures) and failure of the connecting components.

The molded and snap-together designs of related art insulated concrete forms (ICF) products restrict the proper positioning and re-positioning of concrete pumping hoses. Numerous and irregularly placed plastic cross-ties, reinforcing steel supports, form hinges, and braces prohibit correct positioning of the concrete pumping hose. The hose is thereby blocked from easy and repetitive entry into the cavity of the forms and is kept at the top of the wall formwork causing the wet concrete mixture to fall a great distance to the bottom of the formwork. This is results in incorrect placement of the wet slurry concrete mix.

During the pour when the wet slurry mix exits the end of the concrete pumping hose, the aggregates, sand and paste in the wet mixture are separated from each other due to impact with these plastic parts or other obstacles. The individual aggregate rocks bounce, spin, and ricochet away from these obstacles separating the cement paste coating from the aggregate's surfaces. The aggregates reaching the bottom of the cavity are no longer properly coated, and the cured concrete's resulting strength at those locations is therefore greatly reduced.

The concrete mix naturally piles up under the end of the pumping hose. Gravity and vibration equipment tends to settle and spread the pile within the space available. The cavity of the related art formwork does not have any effective vertical barriers acting to limit or block the moving concrete. The design of all related art ICF configurations without vertical barriers for containment results in irregular layering, cold joints, and poor and irregular consolidation of the concrete in the interior cavity of the formwork.

Related art insulated concrete form designs also greatly constrict the use and the effectiveness of vibration equipment. Vibration equipment is necessary to consolidate the concrete mixture, remove air pockets, increase the density of the mixture, and improve the strength of the concrete. The related art formwork with its intervening plastic (or non-plastic) parts confounds the use of portable vibration equipment with semi-rigid shafts because the intervening parts crossing and bridging within the formwork restrict the vertical and horizontal movement of the shaft. The vibration equipment has no steering ability to guide the head through the maze of intervening plastic ties, spacers, and fittings. The head and the shaft also catch on the sharp and irregular shapes of the connection parts disrupting attempts at consolidation. Without effective, continuous, and timely vibration, uniform densities and design strengths cannot be achieved. Vibration equipment can only be used when the concrete mixture is contained within formwork and is not flowing or moving.

After an unorganized accumulation of separated aggregate having less paste has reached a depth of a few feet, an attempt at vibration consolidation might be made. The vibrating head is lowered on a semi-rigid shaft into the mixture described above. As soon as the unit is turned on, any amounts of slurry that have enough paste to promote movement will slide away from the vibration equipment and by gravity's effect, slide to a lower void space in the wall cavity. This occurs, to an extent, because there is no effective vertical plane to block the horizontal movement. This modifies the pile of semi-separated slurry to a well separated and semi-leveled position because the portions of the mix having paste will move away from the less paste covered aggregate. Excessive vibration can remove more remaining cement paste from the aggregate. This results in rock and air pockets, honey-combs, and void spaces.

Creating vertical concrete structures has historically required qualified continuous inspection processes to assure compliance with applicable standards. Construction inspection testing efforts of poured-in-place concrete structures are often thwarted because the sample cylinders of liquid concrete taken from the mixing equipment are consolidated separately using testing laboratory methods. Tests for strength are accurate for those test cylinders, but not representative of the areas of poorly consolidated concrete within insulated concrete form (ICF) walls. Vibration consolidation is difficult to regulate in construction work. In large and small scale concrete projects, it is common to use one or two vibrators per concrete pumping hose. The operators of the vibrators follow the hose positions trying to vibrate the varying amounts of accumulated concrete. Because of the required fast pace of concrete placement, due to the high volume of concrete pumping equipment, irregular and incomplete consolidation is a regular occurrence.

Related art insulated concrete forms have limited resistance to the hydraulic pressures of liquid concrete slurry. ICF manufacturers limit the height of the volume of concrete slurry placed because of the likeliness of formwork failure, known as a "blowout." Field practices must comply with such limitations to avoid the costly complications, delays, and risk of injury due to formwork failure. The concrete is commonly placed at heights recommended at less than four feet, named "lifts" and then given time to harden before more concrete is added on top. The firmer concrete can then support additional lifts of concrete with little fluid pressure on the lower formwork. Due to the necessary delay between lifts, attempts at re-penetration for vibration consolidation of the hardened concrete through the newly placed lift fail regularly. This layering without re-mixing produces a "cold joint" which is incomplete integration of the two lifts. This layering of concrete is unfortunately common and negatively affects the entire project with hidden and continuous cold joints at the intersections of layers.

The related art ICF may have slightly different mechanisms, attachment means, and dimensions, but they all have the same potential failures. During the filling of their product's cavities, the wet concrete mix can and does travel horizontally. The higher the concrete is pumped into one location, the faster it will then flow sideways into a flatter shape. If any vibration is employed on the pile, the greater the distance the liquid concrete can and will flow. This movement prevents any consolidated concrete from staying in one location, and promotes the mixing of consolidated with unconsolidated portions of the mix. Attempting to manage concrete placement, movement, and consolidation from the top of a wall cavity with formwork from the related art is difficult and inefficient.

Some related art ICF products utilize injection molded plastic material placed within the molded expanded polystyrene (EPS) shapes. These products also use tie connectors and experience the problems mentioned previously. Extruded sheet EPS material is now produced with less cost than related art insulated concrete forms. With embodiment of the present invention, EPS sheet material (and other types of wall-formation panels) can now be successfully introduced into the ICF construction industry for applications currently using expensive molded EPS forms with embedded plastic parts.

The purpose of embodiments of the invention is to significantly improve the work product of vertical concrete construction of walls for buildings and other structures by reducing labor and material costs, and better controlling the concrete mix and the resulting product.

Processes described herein utilize known science and physics in a new method of concrete construction that produces the highest quality concrete product possible for the building construction environment. While concrete work has a reputation for limited dimensional accuracy, difficult field work, and intermittent failures, processes disclosed herein greatly improve the finished concrete products, provide easier construction methods and utilize reusable components.

The processes described herein would be utilized in the environment of construction of buildings and other structures. These methods and associated designs will produce concrete assemblies which are highly resistant to damage due to seismic events, hurricane force winds, wild fires, flooding, and impact damage due to flying debris from tornadoes.

Some of the new elements that produce the improvement are the removable, re-useable, arcuate-shaped metal dams and their supporting components. These are positioned vertically in the cavity to be filled with concrete. The dams confine the liquid concrete within particular limits to promote accumulation in a single area allowing the contained concrete to be correctly consolidated with vibration as the cavity is filled. The dams are secured in position only long enough to limit the flow boundaries, then, after adjacent cavities are filled, the dams are quickly removed to facilitate structural bonding between freshly poured adjacent sections. Vertical, removable, re-useable pressure resisting dams are new elements for ICF construction, concrete construction trade work and related industries.

SUMMARY OF THE INVENTION

Embodiments of the invention describe a process utilizing components assembled to contain and shape concrete mixtures during hydration. All embodiments of the process utilize vertical "dams" and dam supports to help create a wall cavity. Traditional wall ties are replaced with wall bolts and sleeves to increase the strength of the supporting structure in addition to minimizing the obstacles to concrete pouring and forming within the wall cavity. The components are assembled and placed on concrete building foundations and secured in place. The configuration of the assembly provides a void cavity where the liquid concrete mix will be placed and shaped to create a structural wall or other vertically-oriented products. A glossary of terms describing the components is contained herein.

Structural concrete walls must be supported by adequately sized foundations, also named "footings." These large supports collect the loads of the structure above and transfer them into the earth providing a safe path for the weight of the concrete walls, and additional forces such as seismic movement, wind, snow, etc. The footings for embodiments of the invention can be standard foundations or foundations designed and built with stem walls to align and support the wall formation panels. Stem walls may be fitted with sleeves for foundation rods for additional framing support. Stem walls may also be notched to provide a step on which the wall formation panels can be positioned. Reinforcing steel deformed bars, named "rebar," commonly used with concrete structural work, are placed at regular intervals within the footing and shaped such that one end can extend vertically in the center of the foundation or stem wall.

Smaller additional steel reinforcing bars are horizontally placed approximately parallel to the length of the foundation or stem wall and secured to the vertical rebar at regular intervals.

Embodiments of the invention process use the components described herein to contain, restrain, support, and shape the liquid concrete slurry mix while it is placed, consolidated, and hydrated (hardened). All embodiments of the process utilize vertical dams (supported by temporary and permanent in-cavity means) to limit the amount of concrete required to completely fill a portion of the project formwork. This greatly reduces the problematic horizontal movement of the concrete mix. As the limited cavity is filled with liquid concrete, continuous vibration consolidation can simultaneously be employed to remove trapped air, and improve the mix density.

Specifically, after the invention's form components are assembled, the cavity between the wall forming panels is unobstructed by accessories required in the related art. To begin the placement of concrete, typically at least one vibrator is first lowered into the cavity approximately to the foundation. Then, the concrete pumping hose(s) is lowered into the cavity so that the end of the hose(s) is just above the level of the top of the vibrators. When the slurry concrete begins to flow from the hose(s) and the vibrator head(s) is submerged, the vibrator is activated thereby consolidating the concrete which has been pumped. Ideally, as the concrete continues to be placed, the hose(s) and the vibrator(s) are lifted and raised together at the same rate of vertical gain as the accumulating concrete. This matched rate of ascendance achieves optimum effect of the vibration on the slurry mix by maintaining ideal positioning for entrapped air to escape the slurry and for consistent consolidation.

The half-circle, or twin half-circle, shaped lengths of dams, vertically positioned, define the width of each cavity. The dam utilizes Pascal's law or the principle of transmission of fluid-pressure by redirecting the direction of the pressure of the liquid concrete to the dam surface instead of the dam supports. The twin dam configuration and its supports block the flow of wet concrete from continuing horizontal movement away from the pumping hose(s). Each dam on its outer edge or edges is supported by ends of edge supports placed in between the wall formation panels. Each dam can be supported on its inner edge by an assembly of supports and clamps. After the placement and consolidation of concrete on both sides of the dams, i.e., within two adjacent wall cavities, the dams are withdrawn vertically from the concrete filled interior of the form assembly. Bonds between the fluid concrete sections in adjacent cavities are quickly and easily made upon removal of the intervening dams without cold joints developing.

Some embodiments of the invention utilize a unique component termed a "nailer" to optionally provide a screw-absorbing surface for the fastening of wall board, plaster, or siding, etc. Nailers are inserted through openings in the wall forming panels and extend into the wall cavity before concrete is poured. Nailers utilize the hardened concrete to maintain their position and have increased cross-sectional material dimensions for superior strength. Positioning of the nailer components during and after concrete hardening remains consistent, regardless of torque, shear, or tensile loading.

Embodiments of the present invention's re-useable pressure restraint systems and components have higher resistance values per square foot, and will contain more concrete hydraulic pressures with less deformation and failure than the related art formwork.

The backing components, named "nailers," receive screws for the attachment of wall covering materials. The nailer design utilizes the strength of the hardened concrete to evenly distribute forces imposed on their surfaces. The process of utilizing these unique components through the wall-formation panels (ex. EPS sheets) for that function is also novel and unique.

Embodiments of the invention allow and promote continuous consolidation of concrete to minimize or eliminate any cold joints between directly adjacent pours. The formwork confines a reduced volume of concrete to be placed at one time. This is new to ICF construction.

Vibration consolidation simultaneously applied in multiple locations within divided portions of poured-in-place formwork for concrete structures is believed to be novel in relation to both traditional concrete pouring and placing methods, and to ICF construction practices.

The potential applications include all vertically positioned, poured-in-place concrete construction projects. Generally, walls of buildings would be the largest use, as well as improving existing methods of poured-in-place projects. Concrete manufacturing produces excellent structures when the mix is contained within the fixed boundaries of the mold and correctly consolidated. Embodiments of the invention bring the advantages and benefits of small scale concrete construction to the building construction industry.

Related art ICF manufacturers have made improvements in their final work products by using self-consolidating concrete (SCC) formulas for their concrete mix designs. These blends of concrete components include additives to improve water-to-cement ratios, plasticizers to improve workability of the wet mixture, and other ingredients. SCC will flow horizontally further than standard mix blends with higher slump values. In poured-in-place applications, flowing further can be misunderstood as an advantage. The entire perimeter wall structure of a home cannot be filled with SCC from a single location. Repositioning of the pumping hose for adding more concrete in some areas is necessary, but this results in additional trapped air. With SCC, settling, self-leveling, and horizontal movement are continuous until the final top level of the formwork is completely filled. The amount of repositioning of the pumping hose is significant and time consuming because the SCC without vertical boundaries settles and flows horizontally while seeking its own level. Dams for vertical boundaries to limit excessive horizontal flow are highly desirable when using SCC high-slump blends of concrete.

Embodiments of the invention are applicable for the placement of self-consolidating concrete mixes as well. The improved flow-ability of these mixes increases hydraulic pressure on formwork in less time than other stiffer mixes. Embodiments of the invention provide effective sealing around horizontal reinforcing members thus limiting excessive concrete mix travel. Embodiments of the invention's formwork pressure restraint systems operate together to evenly distribute loads to steel members. By making the wall formation surface a single piece, optionally supported by a full surface backing member, the blowout potential is significantly reduced and the wall straightness is more easily adjusted.

BRIEF DESCRIPTION OF DRAWINGS

The character of the invention can be understood by reference to an embodiment of one of the processes, as illustrated by the accompanying drawings and described herein.

FIGS. 18 A-D show views of a dam support with a notched bottom section.

DETAILED DESCRIPTION OF A PREFERRED EMBODIMENT

Figure 1:
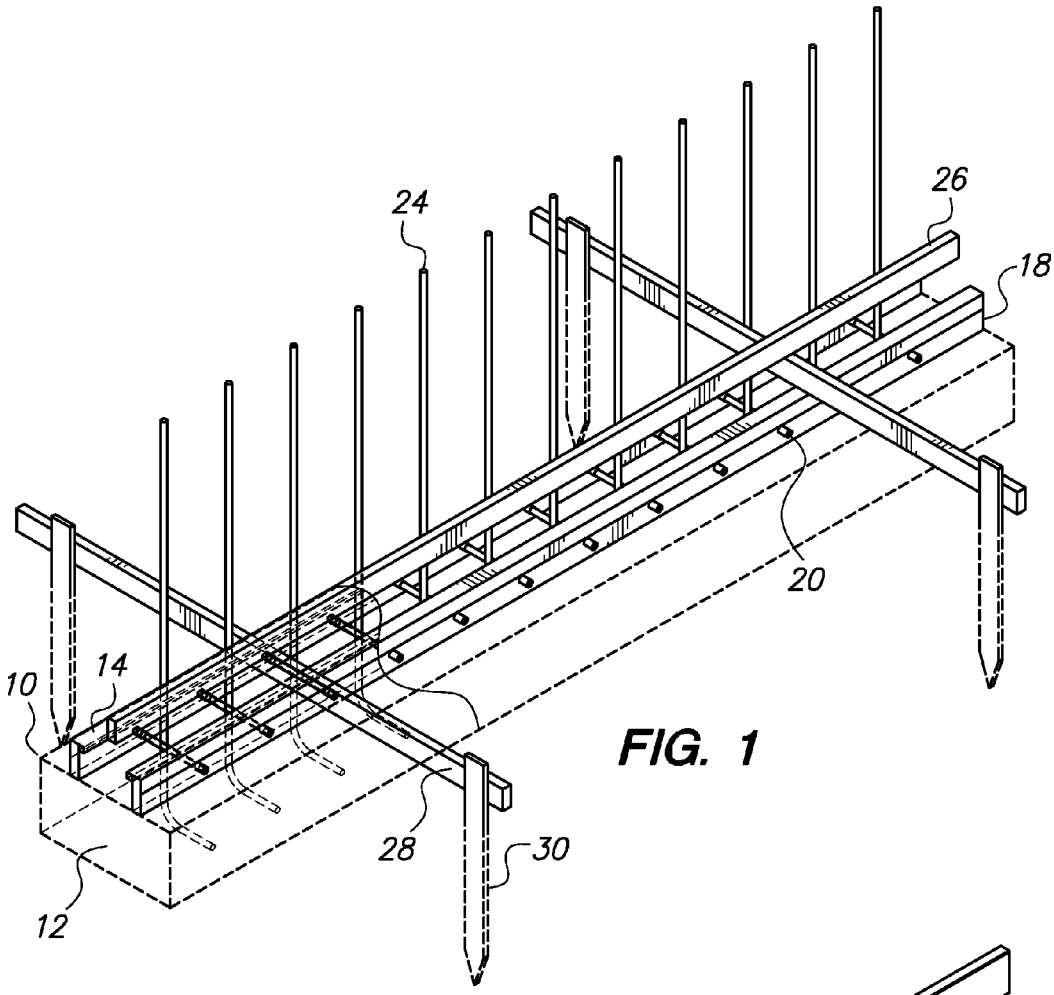
FIG. 1 is a perspective view of the subgrade excavation and foundation and notched stem wall-forming member components.
Figure 2:
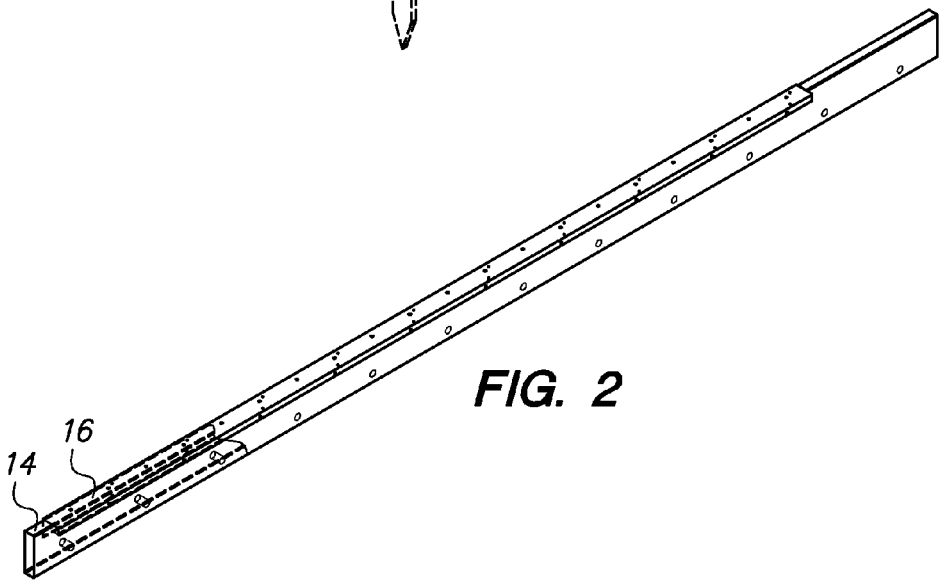
FIG. 2 shows embodiments of the components used to form a notched stem wall.

These drawings show an embodiment of the process for foundation construction and the assembly of the wall forming system. An embodiment of the notched stem wall form 10 and related components are seen in FIG. 1. An outline of the subgrade excavation 12 is shown along with the vertical reinforcing steel members 24, the notched stem wall forms 14,18, the stem wall foundation bolt sleeves 20, the forms 26, 28 and steel suspension means, and the positioning stakes 30. The notched stem wall forming components have a base section 14 and an upper overhanging section 16 as shown in FIG. 2.

Figure 3:
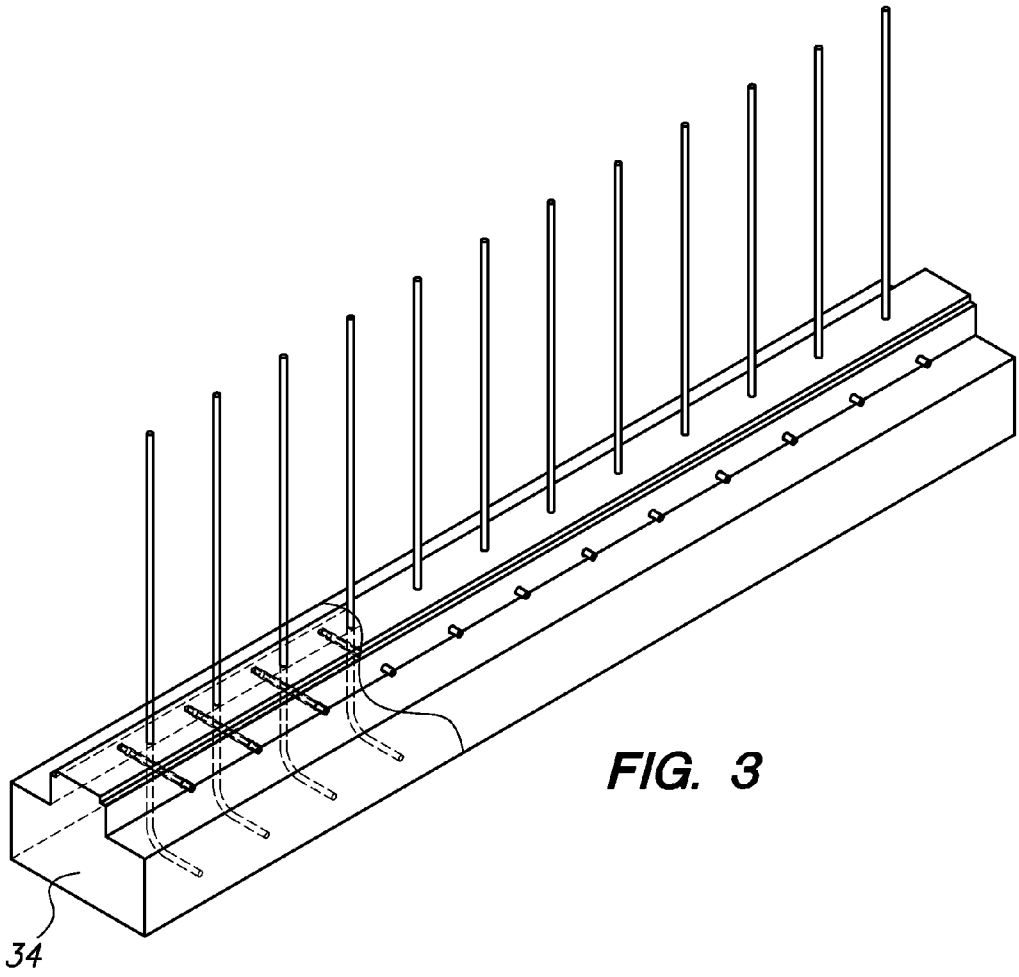
FIG. 3 shows the hydrated concrete shape of the foundation and notched stem wall and embedded reinforcing steel.

FIG. 3 shows the outline of the hydrated concrete shape of the foundation and notched stem wall 34. The stem wall sleeves remain fixed transversely to the longitudinal orientation of the foundation with the sleeve ends exposed. The vertical steel is also captured in the hardened concrete.

Figure 4:
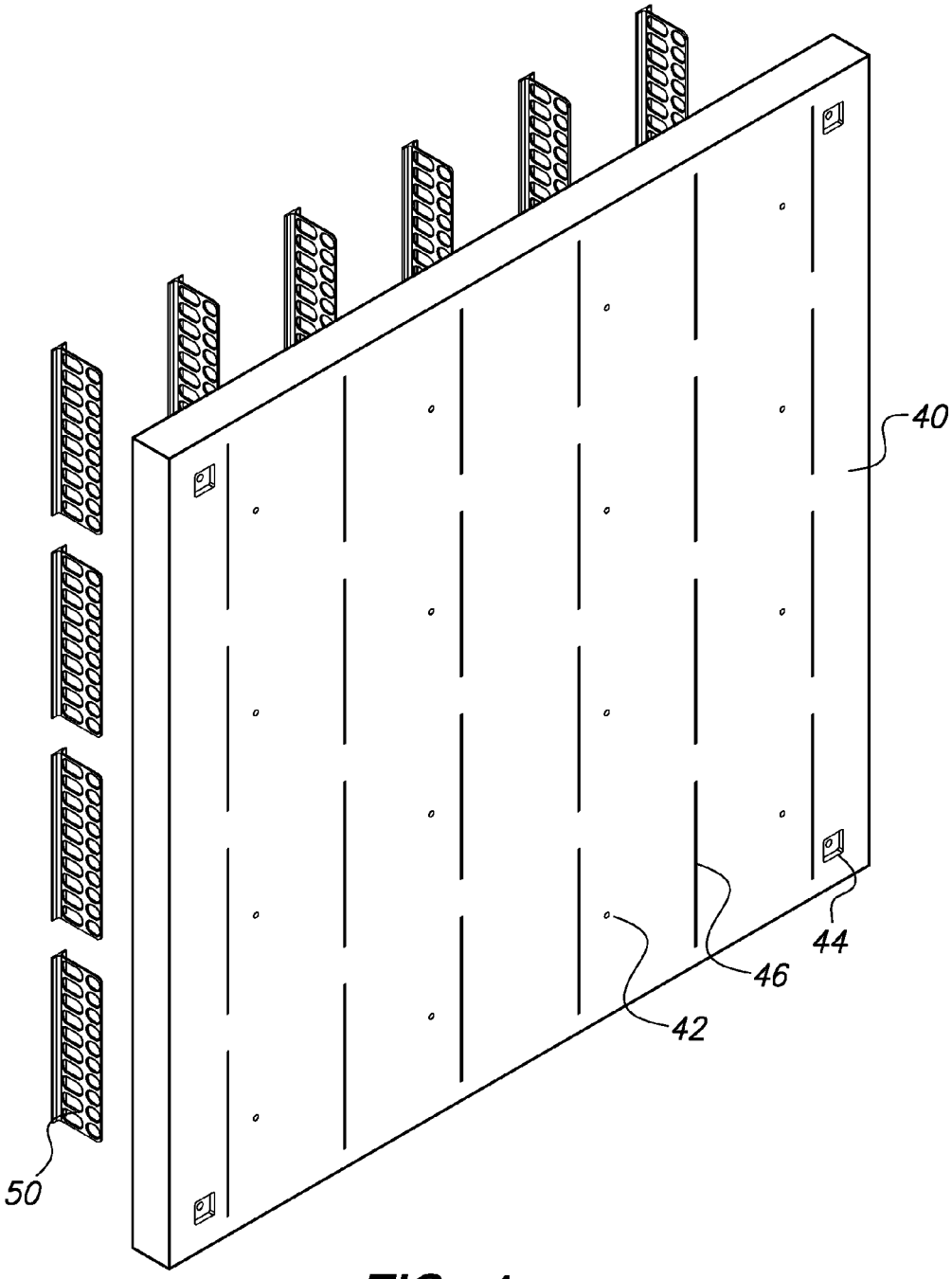
FIG. 4 shows a wall forming panel in the form of an expanded polystyrene (EPS) sheet with openings to accommodate attachable components.
Figure 5A:
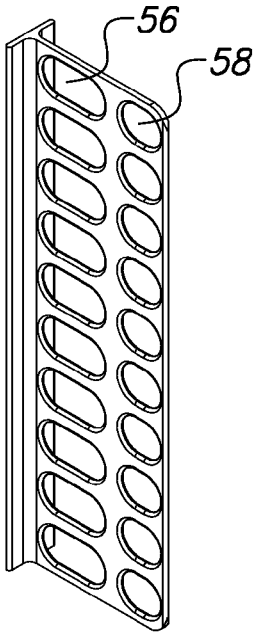
FIGS. 5A-5D show several views of a nailer.
Figure 5B:
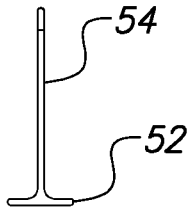
Figure 5C:
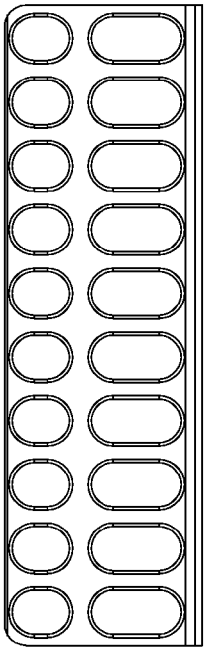
Figure 5D:
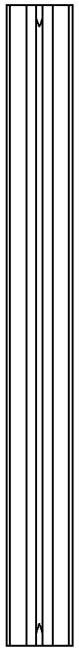
Figure 6:
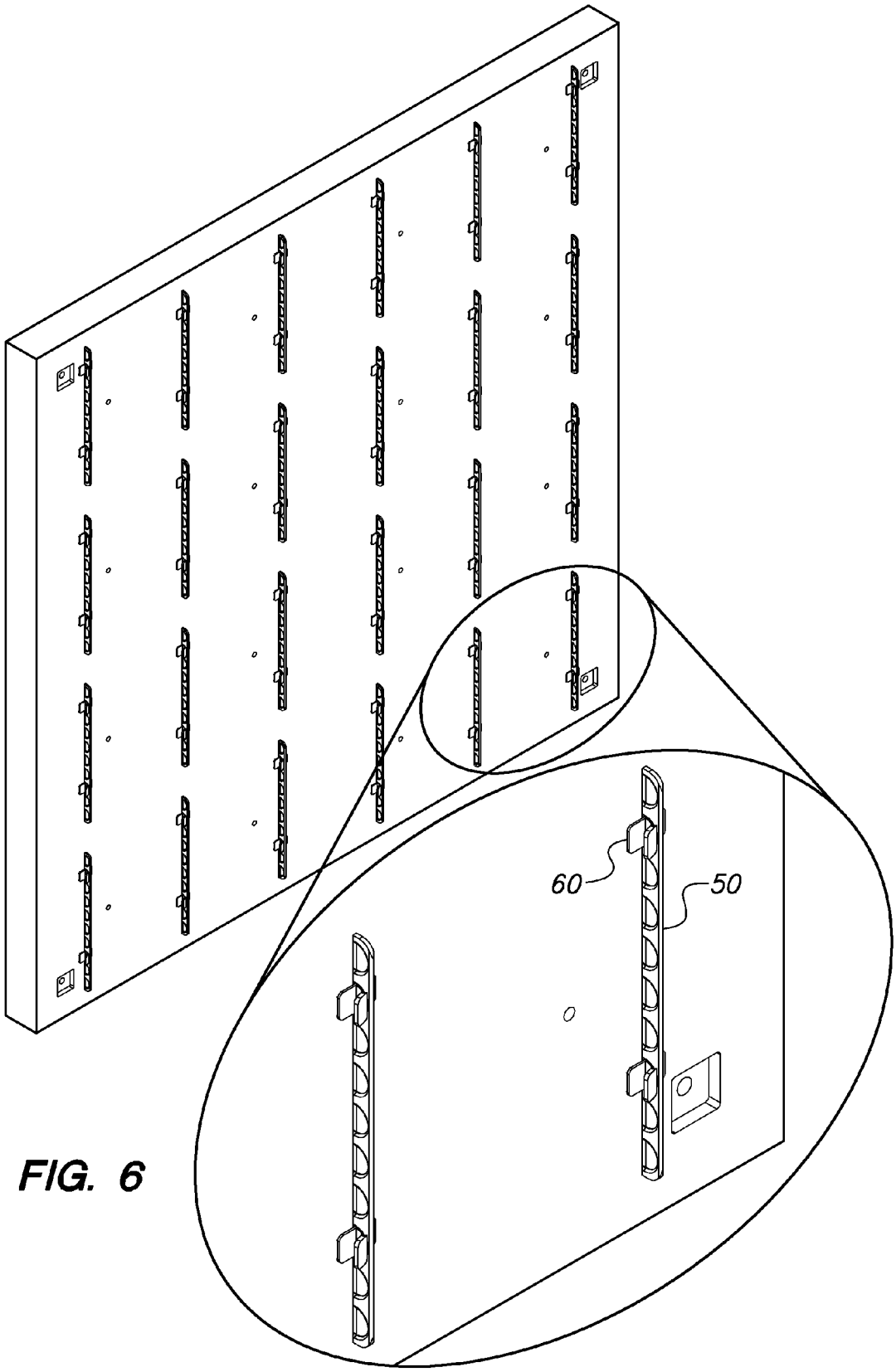
FIG. 6 shows a view of the sheet EPS with components (nailers) set in position and held by retainer elements.

FIG. 4 shows the aligned position of the nailers 50 facing the matching slots 46 or openings cut in the wall panel 40 (sheet EPS as shown). Other openings 42, 44 in the sheet EPS are utilized for fastening and alignment. The nailers are a unique component of embodiments of the present invention and are further illustrated in FIGS. 5A-D. Nailers have a T-section or T end 52 that is positioned against a sheet EPS (or suitable wall panel) and a longitudinal (leading edge) section 54 that is inserted into and partially through the sheet EPS. Upon insertion, the vertical inner edge row of larger openings 56 of the nailer is contained within the sheet EPS. The larger openings 56 reduce material cost. The vertical outer edge row of smaller openings 58 will be partially exposed after insertion as seen in FIG. 6 which shows the opposite side of the sheet EPS. The nailers are held in place by retainers 60. The smaller square recesses are utilized to position and house the backer nuts.

Figure 7A:
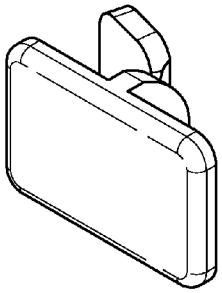
FIGS. 7A-7C show several views of an embodiment of a retainer element.
Figure 7B:
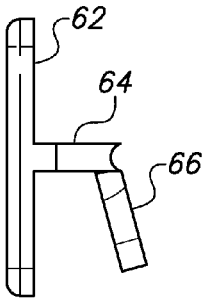
Figure 7C:
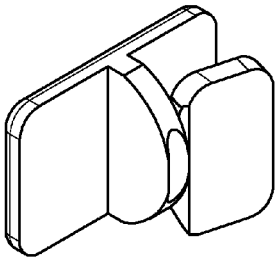

The retainers have an insertion section 62 seen in FIGS. 7A-C that is positioned though the external opening of the nailer and a nailer contact section 64 that can secure the nailer in place. Retainers are typically positioned via use of a handle section 66.

Figure 8:
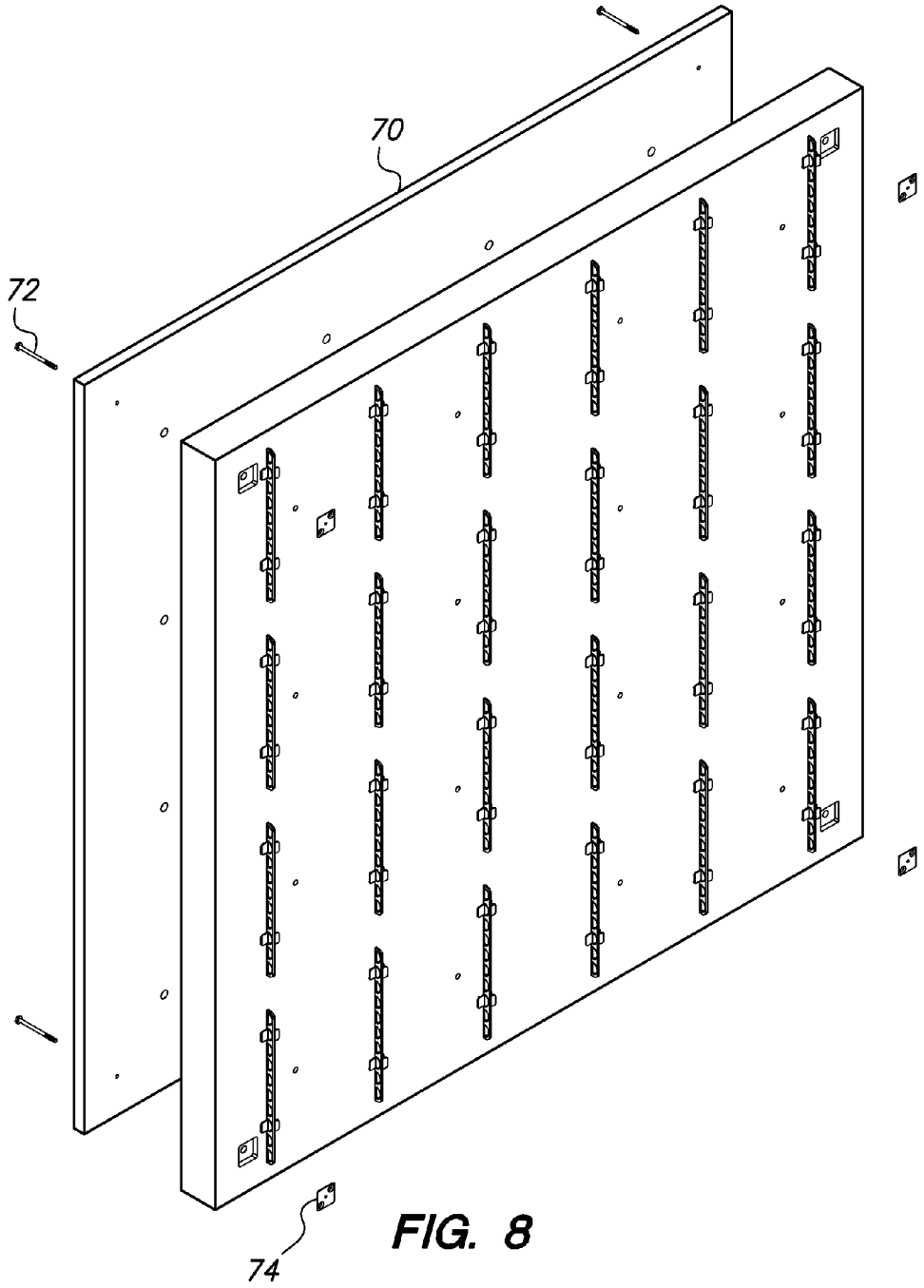
FIG. 8 is an exploded view of the sheet EPS, a backer component and attachable components.
Figure 9A:
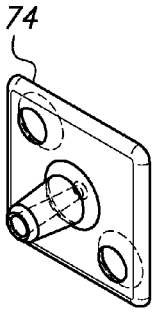
FIGS. 9A-9E show different views of an embodiment of a nut to hold the backer component in place.
Figure 9B:
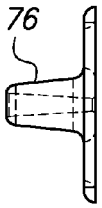
Figure 9C:
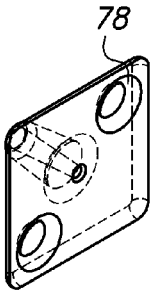
Figure 9D:
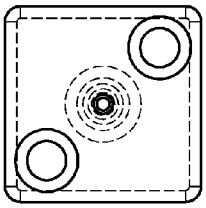
Figure 9E:
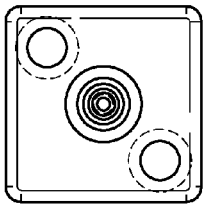

FIG. 8 shows an exploded view of the sheet EPS, the positioned nailers (with only a portion the nailers showing), the backer 70 with its matching hole pattern with the sheet EPS, the backer bolts 72 ready to be inserted through, and then threaded into the backer nuts 74.

Different views of an embodiment of a backer nut 74 are presented in FIGS. 9A-E. In this embodiment, the backer nut has an insertion section 76 and optional openings 78.

Figure 10:
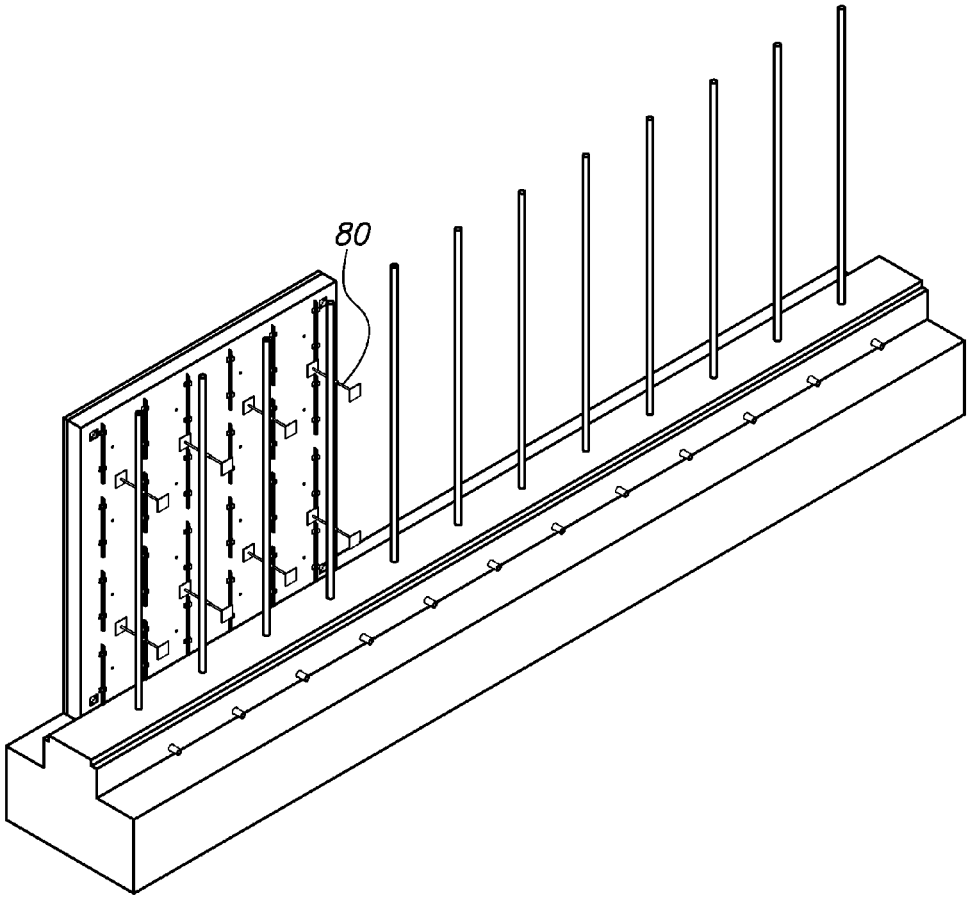
FIG. 10 shows the sheet EPS and attached components on the notch of the stem wall.
Figure 11A:
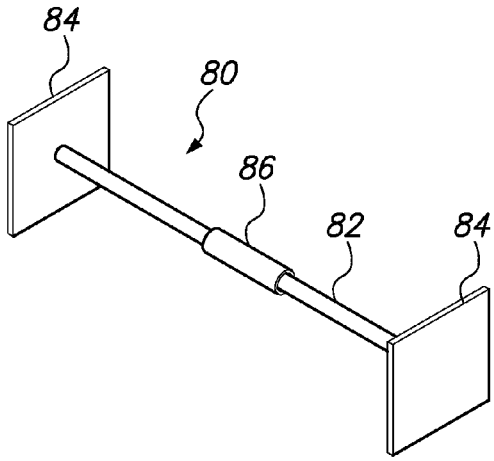
FIGS. 11A-11C show views of the spacer component.
Figure 11B:
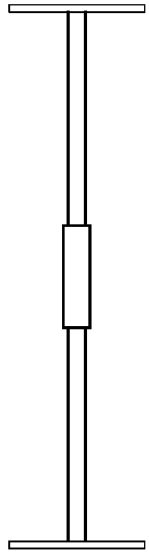
Figure 11C:
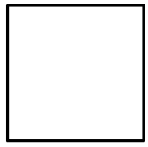

FIG. 10 shows the sheet EPS and attached components on the base of the stem wall with spacer components 80. Typically the spacer components are temporarily positioned relative to the reinforcing supports using wire. FIGS. 11A-11C show different views of the spacer component. The spacer component 80 contains a bolt or similar cylindrical section 82, two end plates 84, and a movable sleeve 86. The movable sleeve allows for efficient alignment with and attachment to the reinforcing bars.

Figure 12:
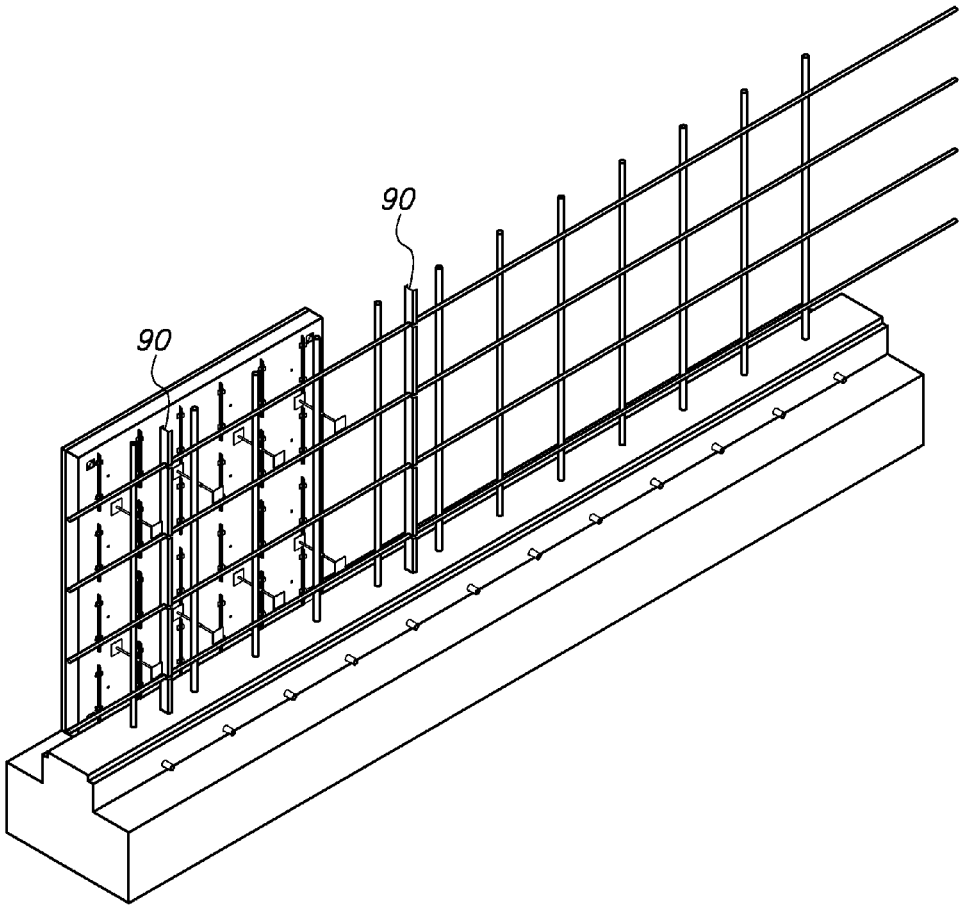
FIG. 12 shows the sheet EPS and attached components in relation to horizontally-oriented reinforcing material.
Figure 13:
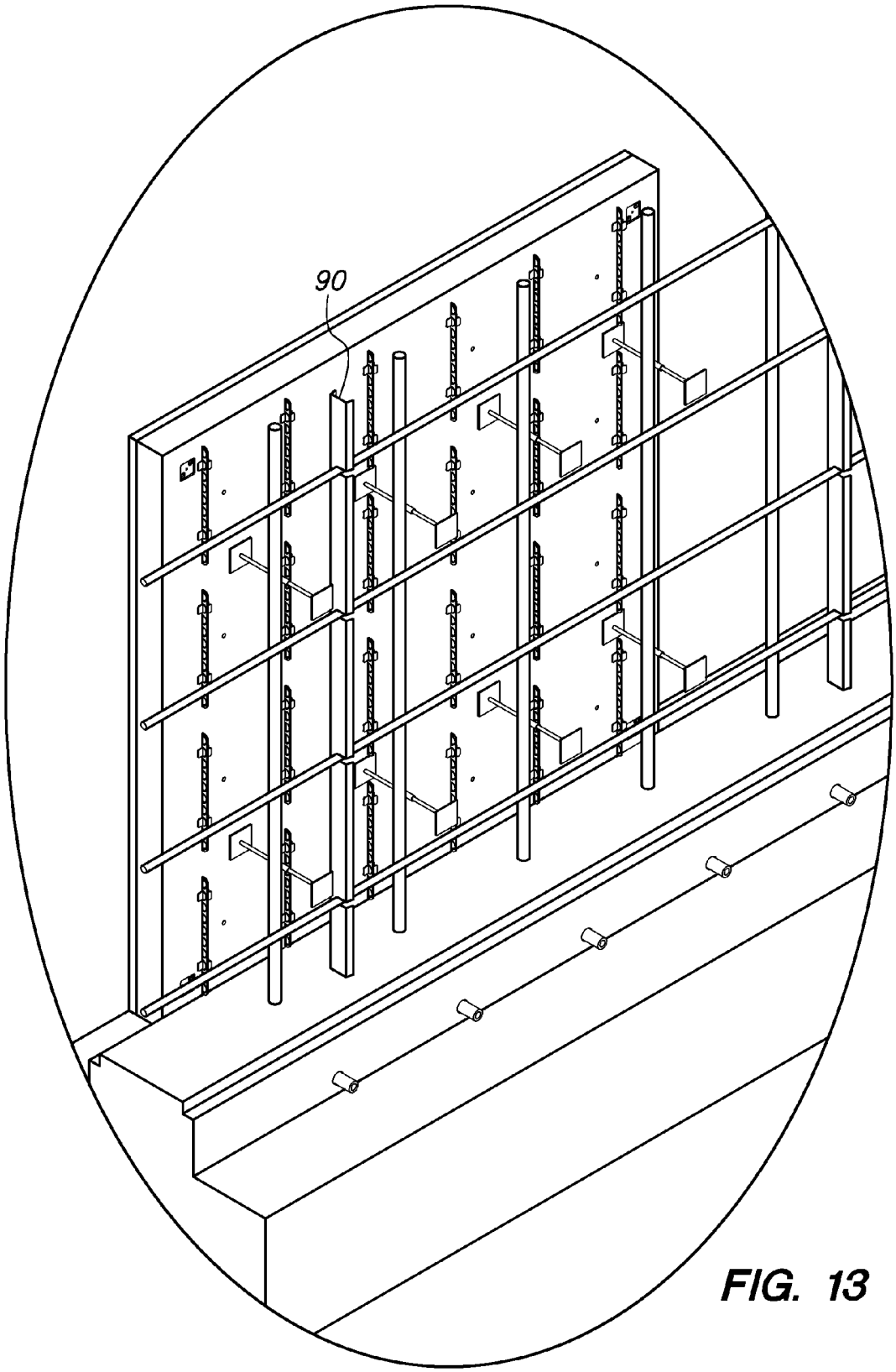
FIG. 13 shows the sheet EPS and assembled components including the dam supports.
Figure 14A:
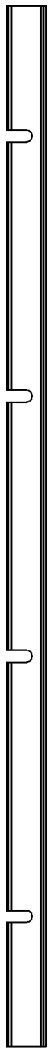
FIGS. 14A-14D show views of a dam support.
Figure 14B:
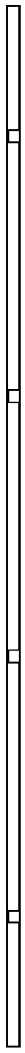
Figure 14C:
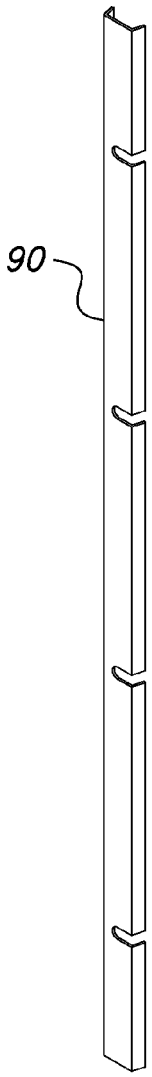
Figure 14D:
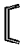

FIG. 12 shows the sheet EPS panel and attached components in position with horizontally-oriented reinforcing material. Also shown are the center dam supports 90. FIG. 13 is a close-up of FIG. 12 showing how the center dam support 90 has an opening to accommodate the horizontal reinforcing bars. Various views of the center dam supports are included in FIGS. 14A-D.

Figure 15:
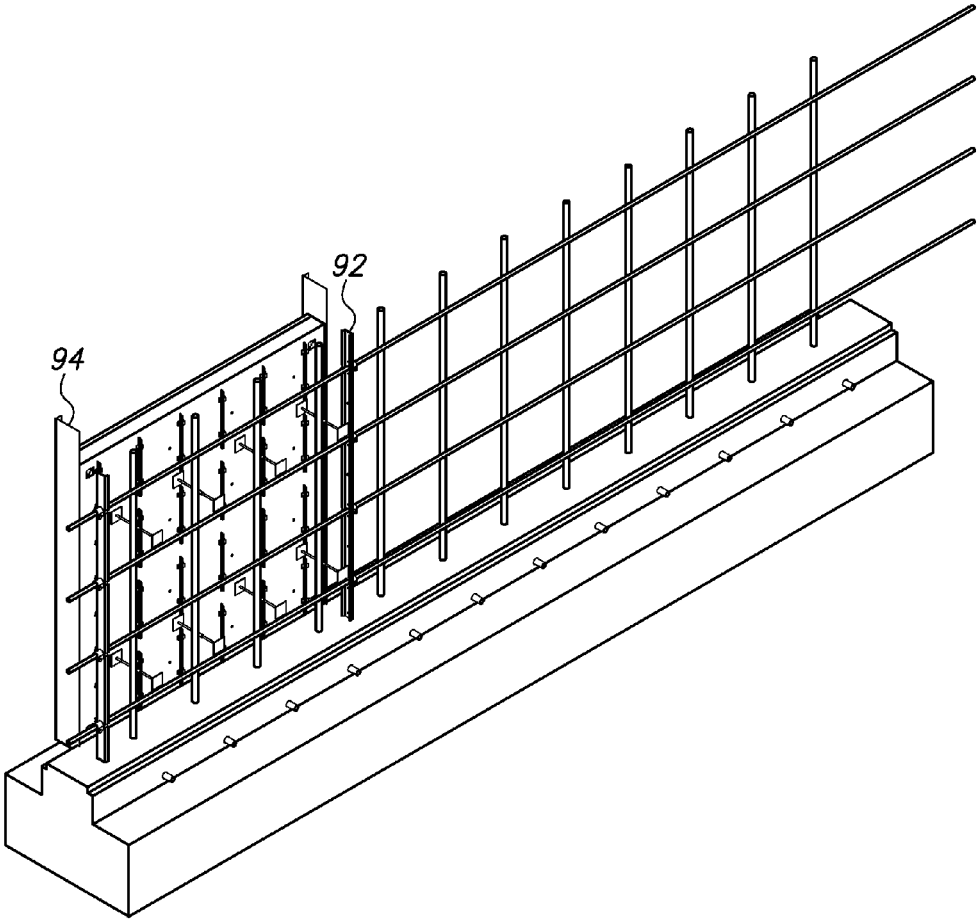
FIG. 15 shows the sheet EPS and additional components for alignment and support of a second sheet EPS.

Mating center dam supports 92 are shown in FIG. 15 and FIGS. 17A-D. These center dam supports are positioned from opposite sides of the foundation so that the rebar is contained within the notches of the two dam supports. One center dam support with an opening to contain the rebar is contemplated. The edge dam supports 94 are also shown in FIG. 15.

Figure 16:
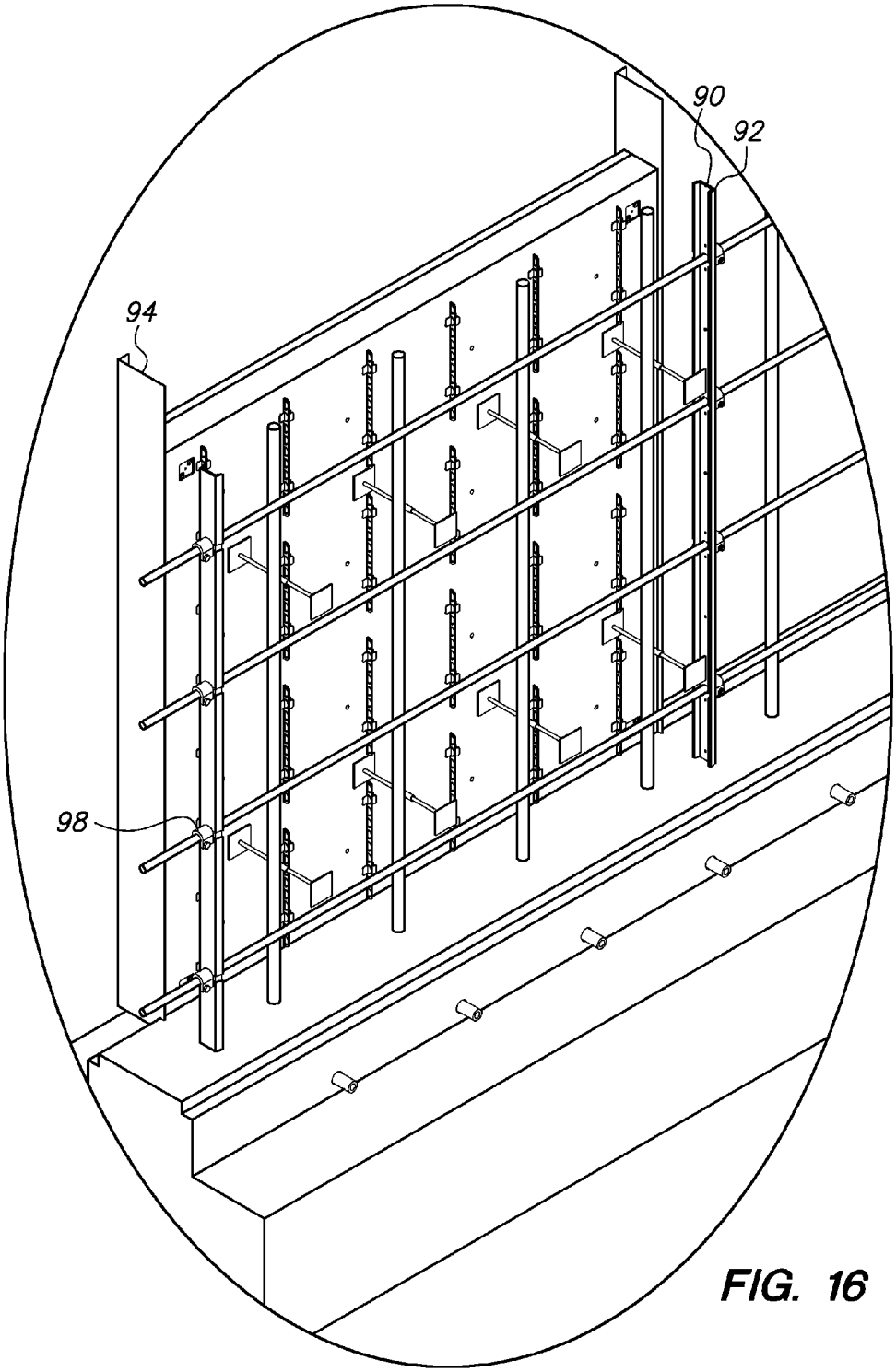
FIG. 16 presents a close-up section from FIG. 15.
Figure 17A:
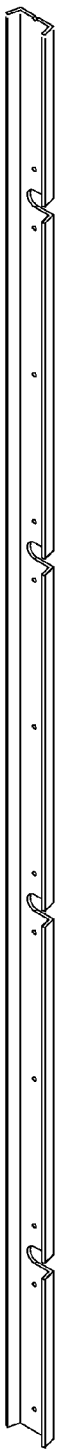
FIGS. 17A-17D show different views of another dam support.
Figure 17B:
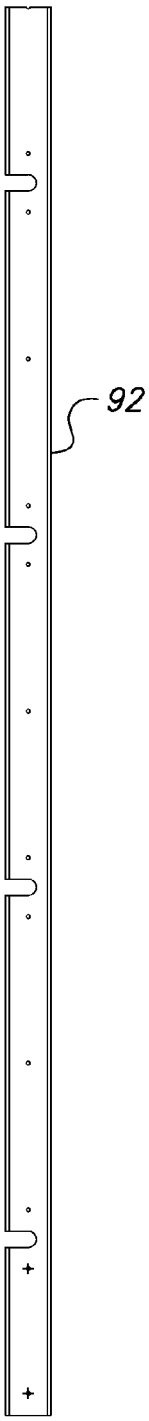
Figure 17C:
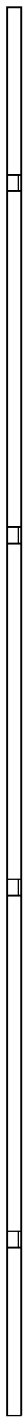
Figure 17D:
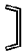
Figure 19A:
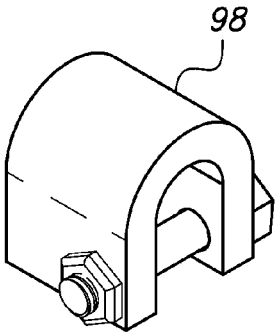
FIGS. 19 A-H show views of a typical clamp.
Figure 19B:
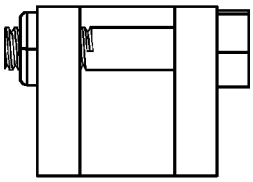
Figure 19C:
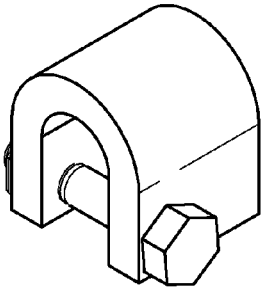
Figure 19D:
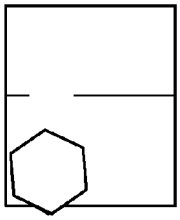
Figure 19E:
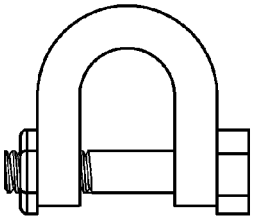
Figure 19F:
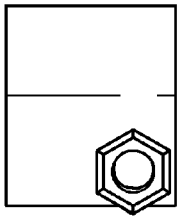
Figure 19G:
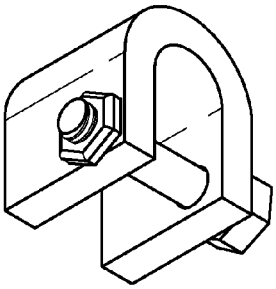
Figure 19H:
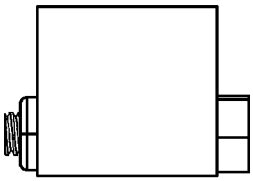

As shown in FIG. 16 with details in FIGS. 18A-D, the edge dam supports 94 are placed at the outer edges of the sheet EPS. An optional notch in the bottom of the edge dam supports 94 align with the notch in the stem wall. FIG. 16 also shows how the mating center dam supports 90, 92 are positioned and how they are held in place by clamps 98. Various views of the clamps are included in FIGS. 19A-H.

Figure 20:
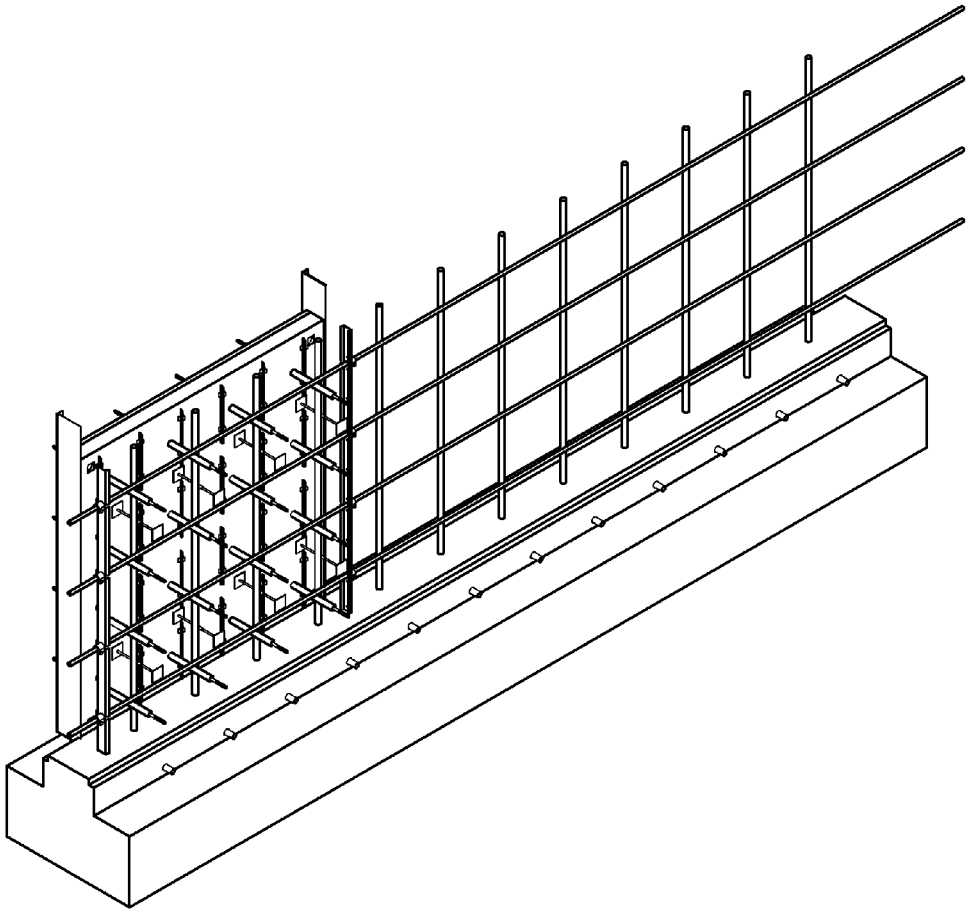
FIG. 20 and the close-up in FIG. 21 show the addition of sleeves and bolts utilized to connect two wall components.
Figure 21:
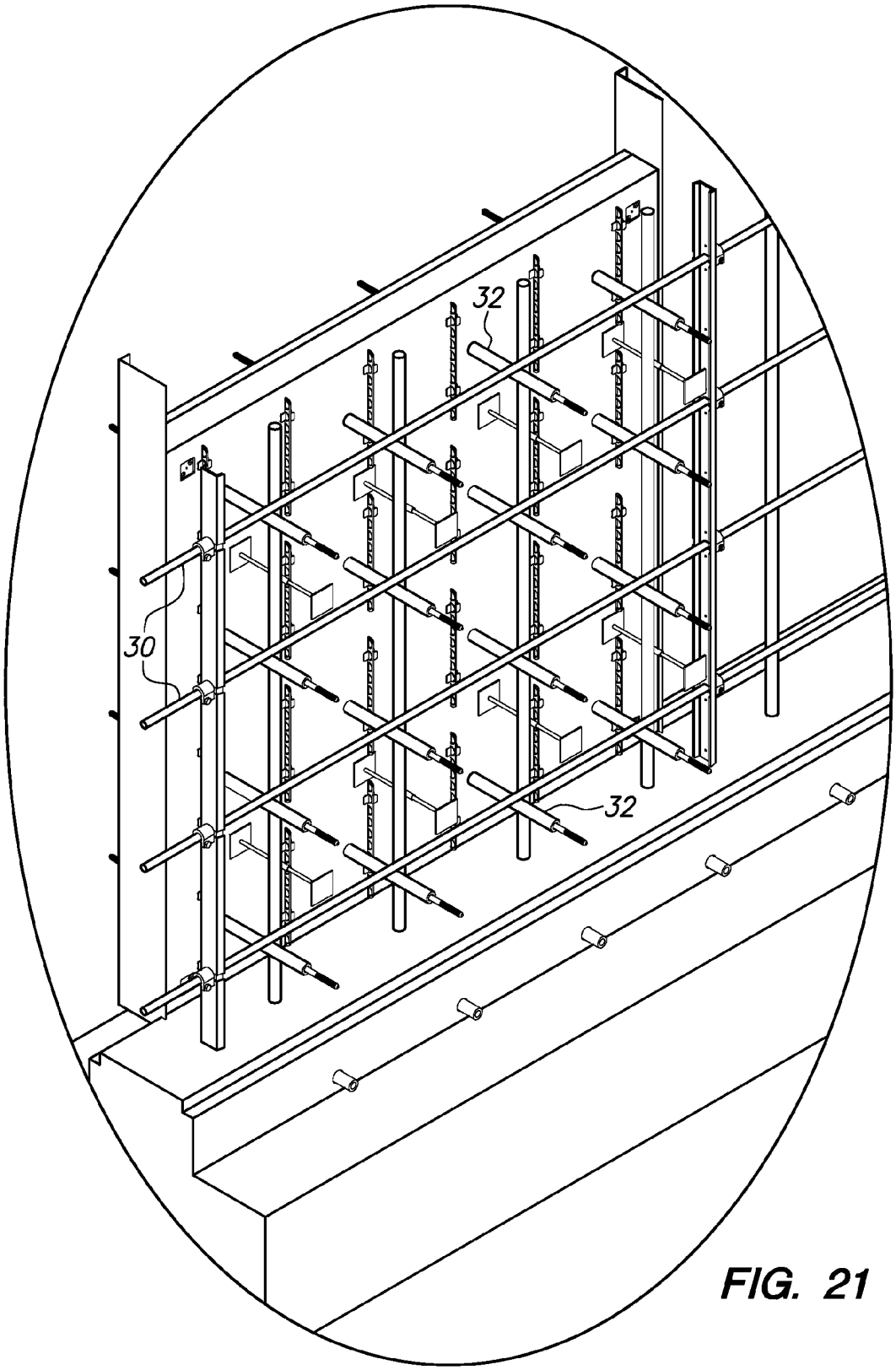
Figure 22:
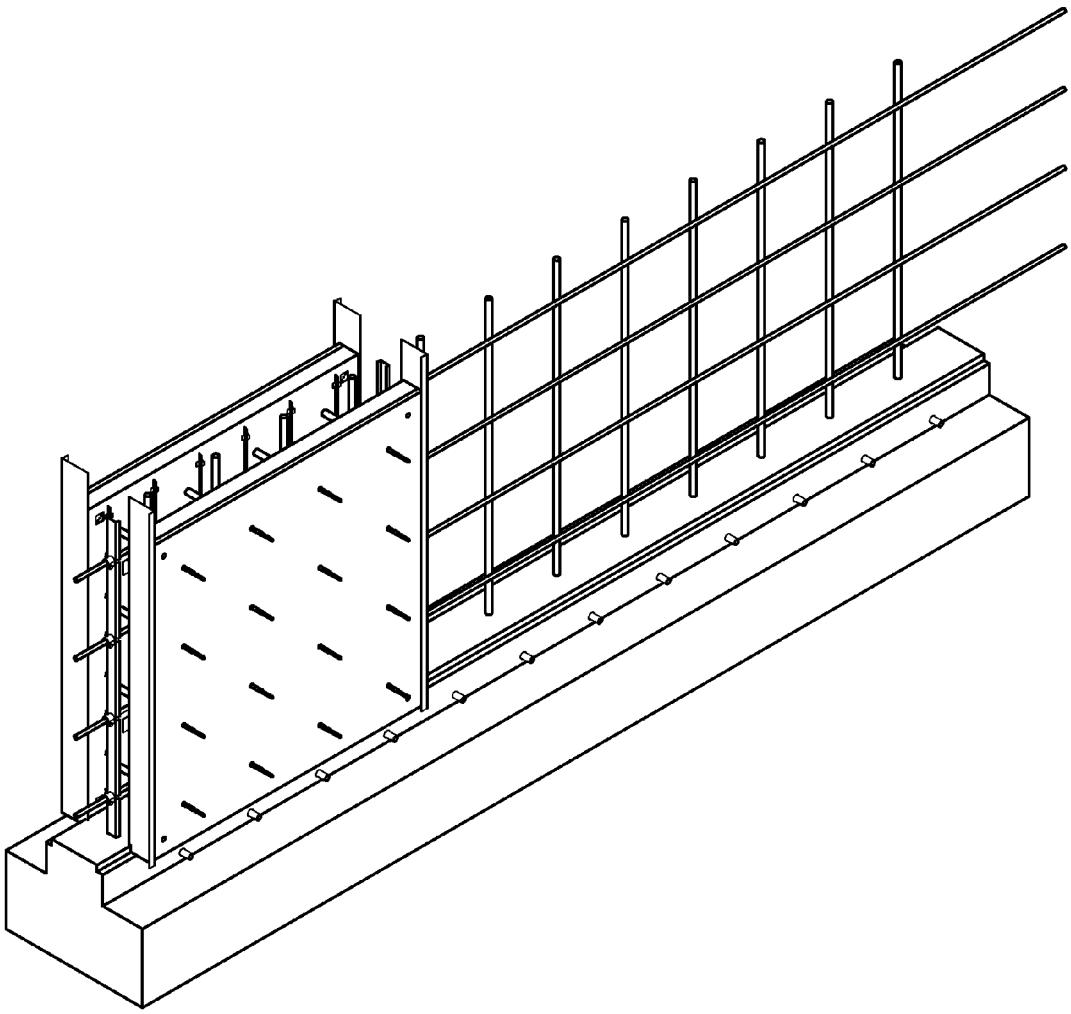
FIG. 22 shows the second sheet EPS with the backer in final position with the wall bolts extended through the backer.

FIG. 20 and the close-up in FIG. 21 show the addition of sleeves and bolts utilized to connect two wall components. The multiple horizontal rigid re-enforcement members 30 are shown in position. The bolt sleeves 32 are shown in position near the vertical and horizontal re-enforcement members. FIG. 22 shows the second sheet EPS as assembled.

Figure 23:
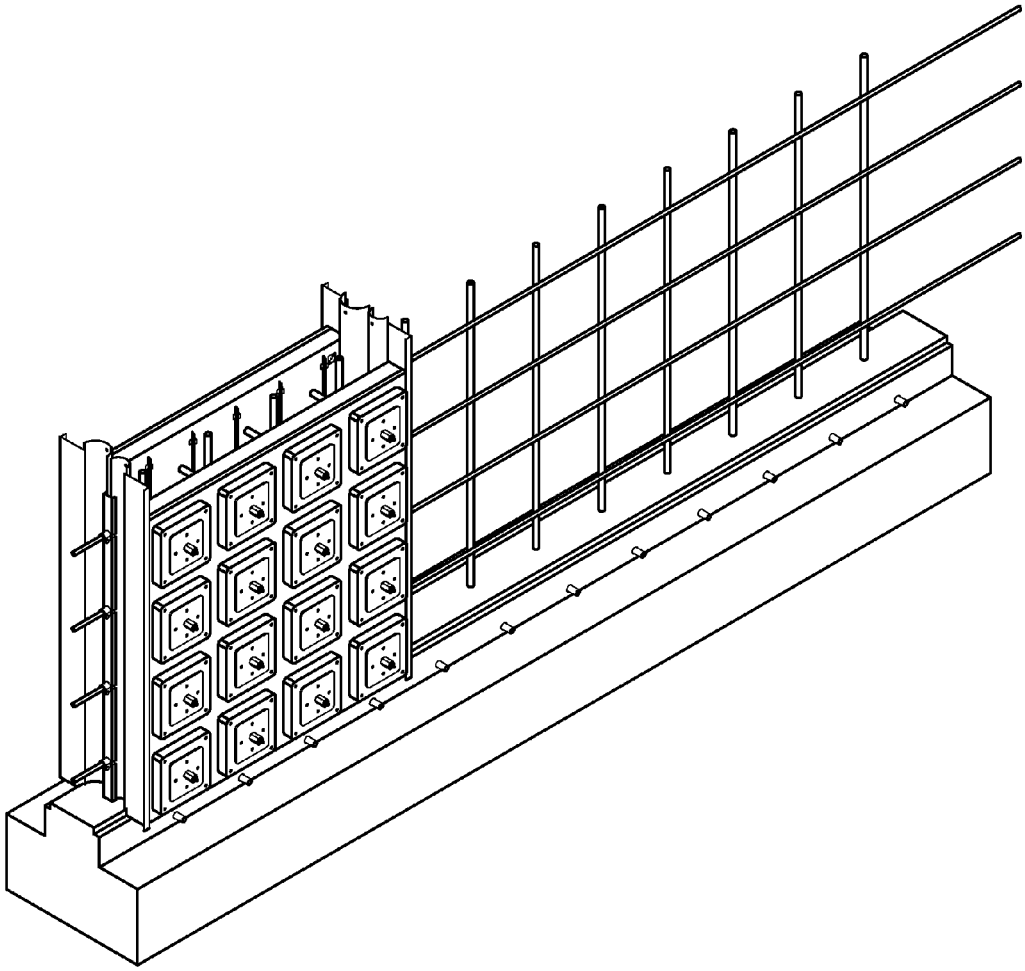
FIGS. 23 and 24 shows the addition of the blocks, plates and nuts in position with each of the wall bolts.
Figure 24:
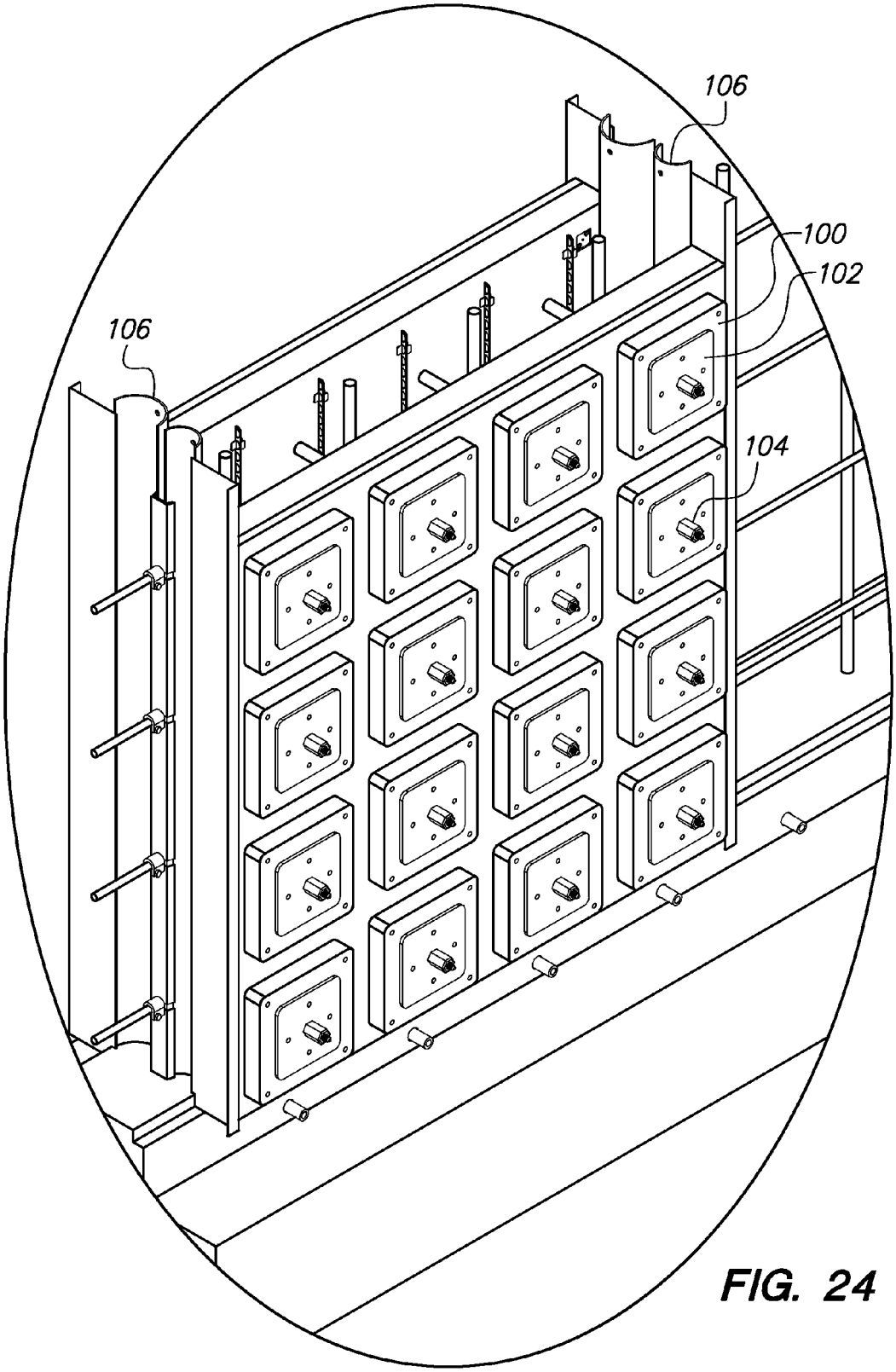
Figure 25A:
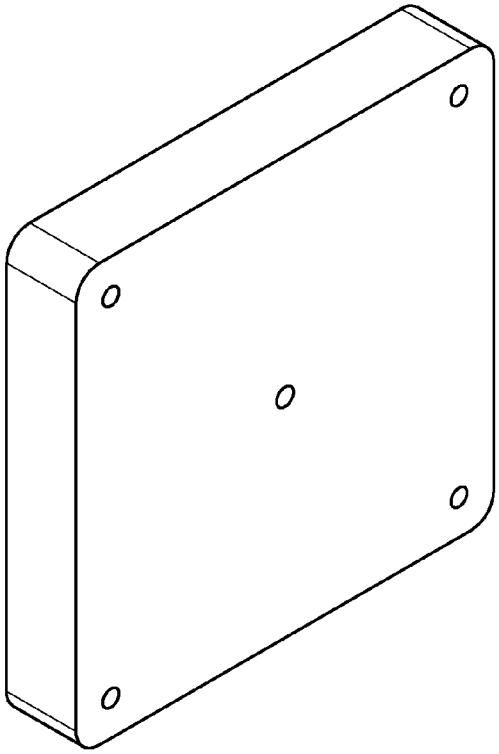
FIGS. 25A-C and FIGS. 26A-C show close-ups of embodiments of securing components.
Figure 25B:
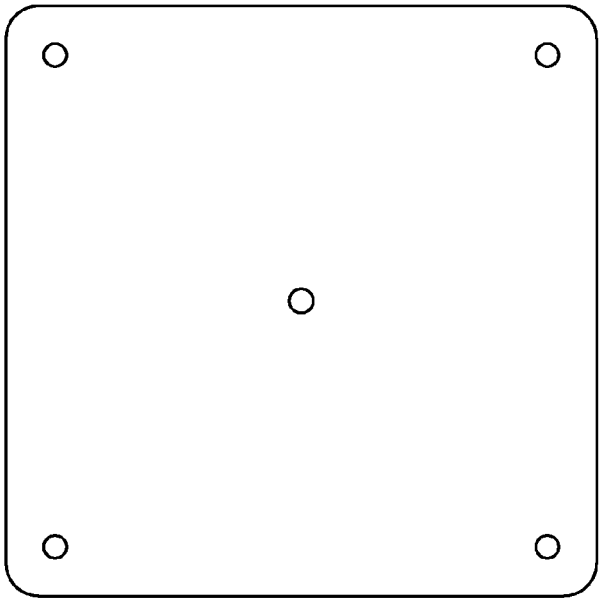
Figure 25C:
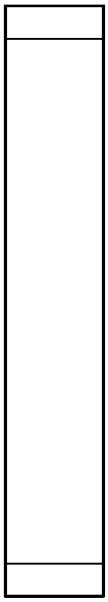
Figure 26A:
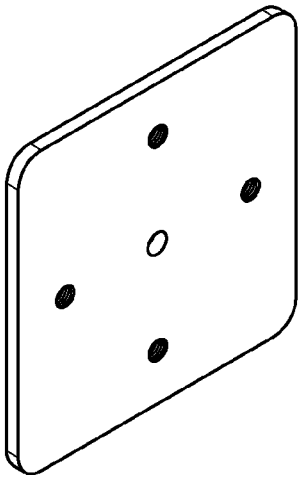
Figure 26B:
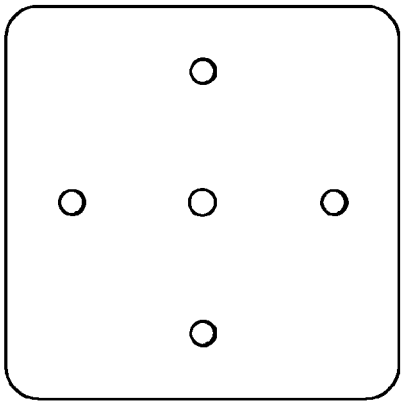
Figure 26C:
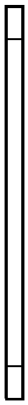
Figure 27A:
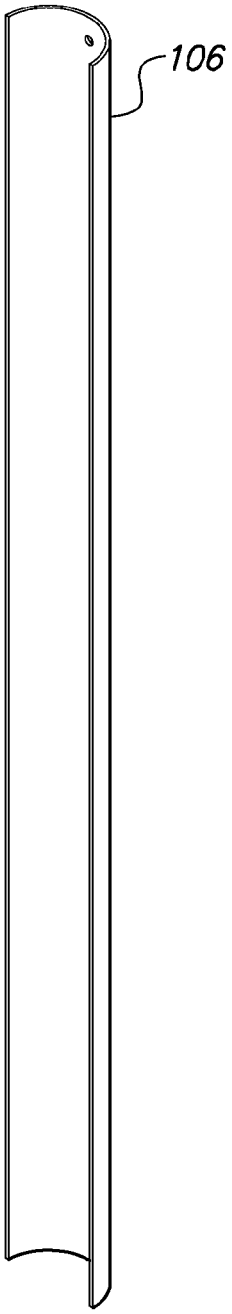
FIGS. 27A-C show an embodiment of a dam.
Figure 27B:
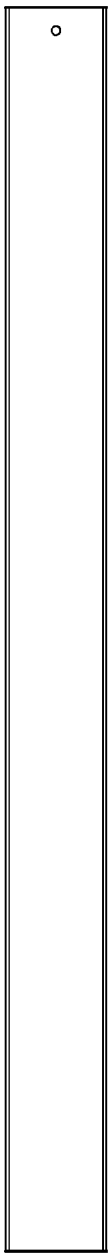
Figure 27C:
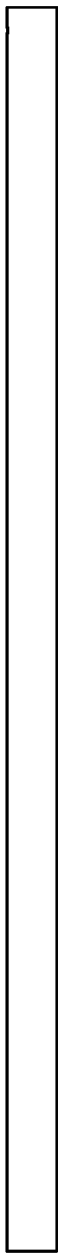
Figure 27D:
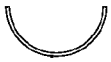

FIGS. 23 and 24 shows securing components in place on the sheet EPS. The semi-annular vertical dam components 106 are shown positioned at opposite ends of a wall cavity. FIGS. 25A-C and FIGS. 26A-C show close-ups of embodiments of securing components.

Figure 28:
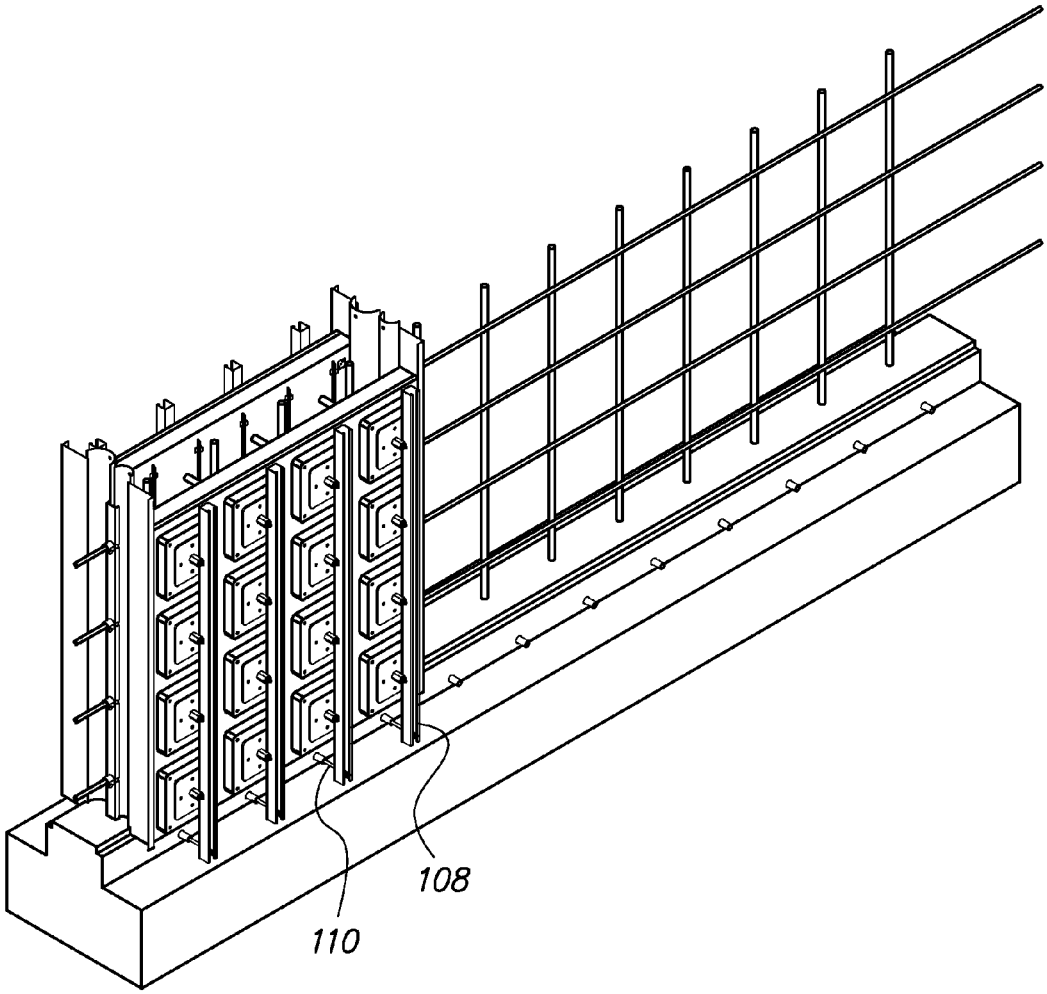
FIG. 28 shows use of optional vertical framing channels which are further shown in FIGS. 29A-D.
Figure 29A:
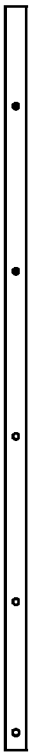
Figure 29B:
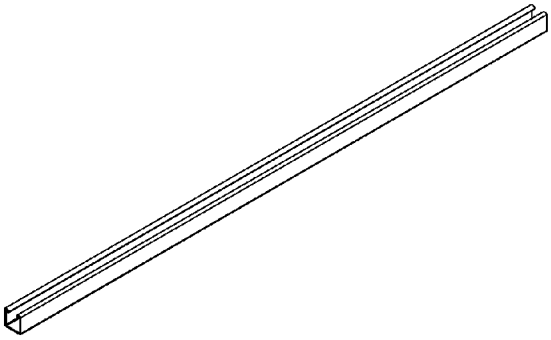
Figure 29C:
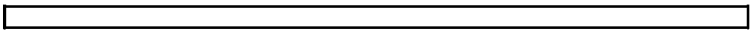
Figure 29D:
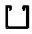

FIGS. 27A-D show an embodiment of a semi-annular dam 106. FIG. 28 shows optional use of vertical framing channels 108 which are further shown in FIGS. 29A-D. Bolts 110 can be installed through the framing channel. This allows the forming system to be adjusted and held in perfect vertical position and for the addition of scaffolding.

Detailed Assembly Steps: The following is a list of assembly steps that are applicable for an embodiment of the invention that utilizes a notched stem wall, sheet EPS wall panels and a backer for the panels.

STEP 1: Utilize earth excavated according to the requirements of the appropriate jurisdiction to provide a void space below grade level that will contain a concrete foundation capable of supporting a structure and its associated loads.

STEP 2: Install reinforcing steel members in the void space according to requirements of the project. Support and secure all steel reinforcing members.

STEP 3: Assemble the stem wall forms and stem wall sleeves by securing the stem wall form component to a support (typically standard 2×6 wood member or similar support). Extend the wood beyond the end of the metal part so the next metal component can be secured to the wood and be directly adjacent to the first metal component. Prepare the other side of the stem wall form similarly then place the stem wall sleeves through the holes in the wood component to complete this assembly.

STEP 4: Install supporting members across the excavation to secure the stem wall forms, and secure the supporting members with stakes driven into the earth. Secure both sides of the stem wall forms so they are substantially level and parallel with each other.

STEP 5: Install vertical reinforcing steel members on regular intervals with one end in the void below grade level, and the other end above and between the stem wall forms. Secure the steel members to supporting members and other steel members as necessary.

STEP 6: Place and consolidate the concrete mix as determined by the project requirements in the excavation and between the stem wall forms. Optionally, allow the concrete to partially hydrate, then rotate the stem wall sleeves to separate the concrete from them allowing them to be removed at a later time.

STEP 7: After complete hydration, remove the stem wall forms, the stem wall sleeves, and all supporting members and stakes.

STEP 8: Assemble the wall forming panels (ex., sheet EPS) and the nailers by sliding the nailers into the openings in the sheet EPS.

STEP 9: Install at least one retainer into the end of the nailers on the other side of the sheet EPS.

STEP 10: Assemble the sheet EPS and the backer by aligning the holes in each and inserting the bolts for the backer and the nuts for the backer. Tighten the bolts to secure the assembly.

STEP 11: Place and support the bottom edge of the assembled sheet EPS on the notch of the stem wall so the backer is outside of the wall cavity area. Temporarily brace the sheet EPS in a vertical position and horizontally so the wall bolt holes are near tangent to the vertical steel.

STEP 12: Install spacers to the vertical steel reinforcing members by tie wiring the sleeve of the spacer to that member on regular centers, horizontally, and mid-way and at the top, vertically. These spacers will keep both sides of the formwork equally distanced from each other while allowing the final adjustment to occur later.

STEP 13: Use at least one center dam support to temporarily position the horizontal reinforcing steel members adjacent to the vertical steel reinforcing members. Secure the horizontal steel reinforcing members to the vertical steel reinforcing members.

STEP 14: Temporarily brace two edge dam supports at the vertical ends of the assembled sheet EPS panel. Position the edge dam supports so the bottom edge of the dam supports are set upon the lower horizontal part of the stem wall notch and coincident with the bottom edge of the sheet EPS.

STEP 15: Position the inner component of the center dam support so that the face of the center of the convex side is coincident with the face of the edge dam support. Utilizing a one or two piece center dam support, position the outer component of the center dam support so that the part mates with the inner part, enclosing the horizontal steel members within the center dam support components. After adjusting the horizontal location, support the assembly by installing a clamp on the horizontal reinforcing steel members to transfer the lateral load into the horizontal steel member.

STEP 16: Insert wall bolts on regular intervals from the backer side towards the wall cavity area so the wall bolts extend three inches past the thickness of the wall. Next, slide the wall sleeves over the wall bolts so the leading end of the wall sleeve makes contact with the sheet EPS surface. The thickness of the sheet EPS and the backer hold the wall bolts horizontally in their holes for future alignment with the mating holes on the next assembly of the sheet EPS panel.

STEP 17: Install the other assembled group of parts including the sheet EPS, the nailers, the backer, and the bolts and nuts to hold them together, to mirror the first assembly, placing it on the notched corner of the stem wall. Push the wall bolts through the sheet EPS assembly so they extend through the same distance as the other ends of the wall bolts remain on the other side.

STEP 18: Position and temporarily secure another edge dam support at each end of the second sheet EPS assembly matching the edge dam supports previously positioned.

STEP 19: Position the dams at each end of the wall cavity using dams sized for the distance between the supporting surfaces. The dams adjacent to each other may have slightly different sizes. Optional holes at the top end of the dam will be used to lift the dam from the concrete just after placement and consolidation.

STEP 20: Install the blocks, the spacers, and the nuts at the ends of each wall bolt on each side of the formwork. Tighten the nuts until slight compression of the spacers against the sheet EPS has occurred.

STEP 21: Place stem wall bolts through the stem wall sleeves. Then, on each side of the formwork, position framing channel members in a vertical direction, with the bottom end of the framing channel in contact with the foundation, over each stem wall bolt, with its other holes concentric with the threaded openings on each plate. Install nuts on both ends of the stem wall bolts. Install short bolts through the framing channel into the plates. Tighten all hardware without adding additional compressive forces into the spacers where they contact the EPS Sheets.

Additional horizontal framing channel members may be added to provide additional linear support to the assembled formwork, as well as to support scaffolding, bracing, gussets, or other accessory components.

GLOSSARY OF TERMS

Aggregate: crushed rock, sand, gravel.

Backer: Typically plywood sheets (sized to match the wall-formation panel) that act as backing for the wall-formation panel to transfer pressure loads and to provide vertical support. The backer also retains the positioning of the nailers if applicable. In some embodiments, the backer/wall formation assembly is placed vertically on the foundation (or edge of the stem wall) with the wall-formation panel facing the center of the wall cavity, and the backer facing away from the cavity.

Blocks: Components typically positioned against the surface of the backer surface to provide resistant to the pressure from the concrete. The block can be placed on the rods on both sides of the formwork assembly.

Cavity: The space between the form surfaces where concrete will be placed.

Center dam supports: Mating (two components) or non-mating (single component) formed sheet metal or non-metallic parts which help limit horizontal flow of concrete and retain the dam's positions. The "center" descriptor refers to the support's placement in the area of the center of the wall cavity in the transverse direction. A center dam support can be used alone, first, to position the horizontal steel during tie wiring to the vertical reinforcing steel members. It can later be relocated and positioned to capture and enclose the reinforcing steel members to prevent the leakage of uncured concrete outside of the cavity area during placement.

Concrete strength: Concrete's resistance to compression and tensile loading.

Dams: Arcuate or semi-annular components that limit horizontal flow of the concrete slurry mix during placement and consolidation by creating a vertical boundary. Dams can contain one or more arcuate or semi-annular sections. After concrete is placed and consolidated on both sides of the dams, the dams are removed allowing the wet concrete mixture on both sides to join and bond without producing a "cold" joint or weakened area. An optional opening on the top end of the dam facilitates a hook or other lifting means to withdraw the dam from the wall cavity for re-use.

Edge dam support: Formed component which retains one edge of the dam to prevent dam movement. This part supports the dam near the edge of the wall cavity and temporarily extends into the wall cavity during concrete placement and consolidation. After concrete is placed on both sides of it, the dam it supported will be removed, and the edge dam support can be withdrawn the amount it was extended into the wall cavity so that it can be reused, and the wall shape is not affected. An optional notch in the edge dam support matches the notch in a notched stem wall. The edge dam support transfers the load from the other end surface of the dams to the wall-forming component because the assembly is held in place and secured and anchored by the stem wall bolts and/or framing channel component assemblies. The edge dam supports are to be moved away from the center of the filled cavity just before the dams are lifted out of the wet concrete mix immediately after filling and consolidation is completed on both sides of the dams. At the edges of the wall-formation panel where a dam assembly is required, an edge dam support is placed with the longer leg of the 'L' shape coincident with the short side of the wall-formation panel. A small portion of the longer leg extends into the cavity to support the outer edge of the dam. The shorter leg of the 'L' shape is used to remove or adjust the edge dam support position. The edge dam support is held in place by the next adjacent wall-formation panel. The edge dam support will be partially withdrawn after placement of the concrete in the cavity, and fully removed and reused after the hydration of the concrete.

EPS: Expanded polystyrene product typically in sheet form.

Formwork: Group of components to shape concrete during hydration.

Foundation rods: Metal rods threaded at both ends to restrain the framing channel components from movement Framing channel: Channel-shaped components having secondary pressure restraint and wall alignment capabilities. For embodiments of the invention, the channels are connected in a vertical position to the foundation rods at the lower end and to optional metal plates at each wall rod penetration. These vertical channels can then be connected to additional horizontal metal framing channels to form a bi-directional grid reinforcing the invention formwork assembly to a very flat plane shape. With this additional rigidity, adjustable bracing can be attached between the metal framing channels and the earth to secure exactly vertical positioning of the completed formwork assembly.

Hydration: the curing and hardening process of concrete.

ICF: Insulated concrete forms

Nailer: Formation component optionally inserted through the wall-forming panels and secured from withdrawal by cured concrete. The 'T' shape of the nailer limits the travel of the part through the wall-formation panels to where the underside of the top of the T is coincident with the recessed surface of the shaped cut in the panel. The face of the top of the T of the nailer remains exposed after concrete hydration for the attachment of the wall covering surfaces, held by screws or other means to the nailer. The smaller openings through the sides of the nailer, closer to the end of the part, restrict the concrete from flowing further into the nailer and panel. The small opening is partially exposed on the inside of the wall cavity side after insertion.

Notched Stem Wall Form: An optional, L-shaped configuration of wood, metal or any suitable material. The notched stem wall form consists of opposing sections, each of which can be made of one or more components. Each section can have holes on regular intervals for the insertion of the stem wall sleeves.

Nuts: Internally threaded metal fittings which transfer pressure stress into the rod material. After the rods are inserted through the wall-forming components, the blocks, and the plates, the nuts are threaded onto the rods and tightened. This torsion applies additional pressure through the materials and into the spacers and the ends of the rods' sleeves causing additional rigidity in the invention assembly.

Plates: Typically metal squares to collect and focus pressure to the rod and nut connection.

Retainer: This is used to hold the nailer in position. It is inserted through the small opening exposed in the nailer and is held by the compression of the wall forming panel against its flat side.

SCC: Self-consolidating concrete, blends of concrete with components that improve flow rate.

Sheet EPS: A type of wall-formation panel made of expanded polystyrene of varying widths and lengths and a standard depth. Sheet EPS, and other wall-formation panels, can have a number of shaped cuts through the material used to position attachments such as nailers. Holes can also be utilized to allow for bolted connection to the backer or similar component.

Sleeves: Cylindrical, hollow components that allow withdrawal of the wall and foundation rods. Sleeves can be utilized in the stem wall section or the concrete wall section. The stem wall sleeve penetrates both sides of the stem wall forms. The concrete wall sleeve typically does not penetrate the wall-formation panel. The length of the wall sleeve is approximately equal to the width of the wall cavity. These sleeves can be installed with the initial positioning of the wall rods.

Spacer: Distance-maintaining components with flat ends and a connecting rod within an adjustable sleeve. The spacer maintains the correct distance between both sides of the wall formation panels and allows movement in relation to the reinforcing steel located midway. The distance between the ends of the spacer is the same as the thickness of the wall cavity. This allows the sleeve to be tie wired to the vertical steel member and the rod can slide through the sleeve for adjustment purposes.

Stem Wall Bolt: A cylindrical rod with matching threaded and shaped ends which can extend completely through the stem wall, through a stem wall sleeve and can be re-used after the concrete hydrates and the forming system is removed. This stem wall bolt is a supplemental pressure-resisting component and adds additional strength at the lower portion of the wall cavity where pressures are much greater.

Stem Wall Sleeve: Cylindrical component utilized during the placement of concrete but may be removed or loosened during hydration for conservation.

Slump: Distance liquid concrete will naturally settle due to fluidity.

Slurry: Concrete mix in a fluid state including ingredients of the blend utilized.

Vibration consolidation: Method of removing trapped air from fluid concrete mix.

Wall-Forming Panels: The wall-forming panels (or wall panels) may be comprised of any suitable material of appropriate dimensions. Some embodiments of the invention utilize sheet EPS as the wall-forming panels. Sheet EPS panels may be then left in place after wall construction. Other embodiments use sheet EPS panels with a backer panel for further functionality.

Wall rods: Machined steel rods with threads cut into each end utilized to resist hydraulic pressure.

CONCLUSIONS, OTHER EMBODIMENTS, AND SCOPE OF INVENTION

All embodiments of the present invention utilize 1) a foundation or footing with reinforced steel, 2) wall forming panels above the foundation or footing, 3) arcuate dams, 4) dam supports and 5) fasteners to position opposing wall forming panels. Embodiments of the invention utilize variations of these components as well as additional components.

The foundation or footing may be of standard configuration or may contain a stem wall component. The stem wall may contain sleeves embedded within to accept bolts or other securing devices. In some embodiments, the stem wall may be notched to support a wall forming component.

The wall forming panels may be comprised of any suitable material of appropriate dimensions. Some embodiments of the invention utilize sheet EPS as the wall forming panels. Sheet EPS panels may be then left in place after wall construction. Other embodiments use sheet EPS panels with a backer panel for further functionality.

Where future wall covering attachment means are required, nailers are placed through the recesses within the wall forming panel (ex., sheet EPS) so that the top of the 'T' shape is coincident with the exterior side of the sheet EPS. The bottom of the 'T' shape extends through the panel so the liquid concrete mix will flow through the multiple openings and into the sheet EPS. Upon hydration, the nailer is firmly restrained from movement. Particular areas of the sheet EPS may have wood backing materials installed. In these specific areas, nailers are optional. The nailers can be placed in the sheet EPS in multiples before the time of actual use. Retainers secure nailers during assembly, movement, or transportation.

The center dam supports can be formed with one piece of material or multiple pieces of material. The center dam supports illustrated herein are made of two mating components.

The dams can contain one or more arcuate, curved section. The dams illustrated herein have one curved section and thus, two dams are utilized on each end of the wall cavity. Another embodiment of a dam could have two curved sections, ex., a rounded "m" configuration. Only one multiple curved dam would have to be used at each end of the cavity to impede the horizontal flow of concrete with this embodiment.

The enclosed description presents the best mode contemplated in carrying out embodiments of the invention. However, it is susceptible to modifications and alternate constructions from the embodiments shown in the drawings and accompanying description. Consequently it is not intended that the invention be limited to the particular embodiments disclosed. On the contrary, the invention is intended to cover all modifications, sizes and alternate constructions falling within the spirit and scope of the invention as expressed in the appended claims or the equivalents thereof.

What is claimed is:

1. A method for forming a vertical wall cavity above a raised foundation, the foundation characterized by multiple vertical rigid re-enforcement members linearly arrayed and protruding therefrom, comprising the steps in order:

(a) utilizing a raised foundation characterized by multiple vertical rigid re-enforcement members linearly arrayed and protruding therefrom, or providing a raised foundation characterized by multiple vertical rigid re-enforcement members linearly arrayed and protruding therefrom;

(b) securing multiple elongate spacers to the vertical rigid re-enforcement members, the spacers spatially positioned in the direction of the thickness of the wall cavity to provide substantial parallelism to the width of the wall cavity;

(c) securing multiple horizontal rigid re-enforcement members to the vertically protruding re-enforcement members, the horizontal members spaced apart and positioned in the direction of the longitudinal axis of the raised foundation;

(d) orientating and positioning a first wall panel vertically atop the raised foundation, the inside surface of the panel making contact with the facing ends of the multiple spacers defining a first major cavity wall;

(e) positioning and securing an edge dam support vertically at each side edge of the first wall panel, the inner surface of the edge dam supports making contact with the edge surface of the adjacent wall panel;

(f) positioning and securing a center dam support at each end of the vertical wall cavity area, the inner surfaces thereof lying in substantially the same plane as the inner surfaces of the edge dam supports;

(g) Inserting two or more fastener bolts having threaded ends through openings provided through the first wall panel, the bolts extending past the thickness boundary of the wall cavity area;

(h) orientating and positioning a second wall panel vertically atop the raised foundation in mirrored alignment with the first wall panel and inserting the fastener bolts through aligned openings provided through the second wall panel, the inside surface of the second panel making contact with the remaining ends of the multiple spacers defining a second major cavity wall;

(i) positioning and securing an edge dam support vertically at each side edge of the second wall panel, the inner surface of the edge dam supports making contact with the edge surface of the adjacent wall panel;

(j) tightening the wall panels together against the multiple spacer ends; and (k) securing at least two semi-annular vertical dam components at each open end of the wall cavity area with one vertical edge of the first and second semi-annular dam components resting against the inside surface of a center dam support and one vertical edge of the first and second semi-annular dam components resting against the inside surface of an edge dam support, the vertical dam components defining the end boundaries of the vertical wall cavity along the longitudinal direction of the raised foundation.

2. The method of claim 1 wherein the above ground portion of the raised foundation is formed in the shape of an elongate rectangle with opposing peripheral shelves formed along the length thereof, the shelves providing secure footing for opposing wall panels.

3. The method of claim 2, wherein in step (d), the wall panel rests on one of the peripheral shelves making contact on the bottom surface and interfacing surface of the wall panel.

4. The method of claim 2, wherein in step (e), the edge dam support is notched at the bottom corner interfacing the raised foundation, the corner sized to enable a fit against the interfacing peripheral shelf.

5. The method of claim 1, wherein the raised foundation includes a plurality of bolt sleeves linearly arrayed and protruding horizontally therefrom, the sleeves substantially perpendicular to and adjacent to the vertical re-enforcement members, the bolt sleeves serving as passage ways for through insert of threaded foundation bolts extending beyond the thickness boundary of the wall cavity and the positioned walls.

6. The method of claim 1, wherein in step (b), an elongate spacer comprises a rigid linear member flanked by substantially perpendicular end plates affixed to the ends of the linear member and, a sleeve having internal dimensioning slightly larger than the outside dimensioning of the linear member slidably fitted over the linear member.

7. The method of claim 6, wherein the spacer is secured to the vertical rigid re-enforcement member via the sleeve leaving the position of the spacer adjustable.

8. The method of claim 1, wherein in step (c), the horizontal rigid re-enforcement members are held in spaced-apart position during installation by at least one vertically-oriented center dam support, the support including a slot pattern of equally spaced-apart slots along one edge, the inside diameter of the slots held slightly larger than the outside dimensioning of the horizontal rigid re-enforcement members.

9. The method of claim 8, wherein in step (f), the center dam supports are fitted to the horizontal re-enforcement members by virtue of the slot pattern.

10. The method of claim 9, wherein in step (f), the center dam supports are secured in position by one or more semi-annular clamps mounted over the horizontal re-enforcement members, the clamps serving as positioning stops to hold the dam supports in a substantially vertical position at each end of the wall cavity area.

11. The method of claim 1, wherein in step (c), the horizontal re-enforcement members are secured to the vertical re-enforcement members via construction ties.

12. The method of claim 1, wherein in step (d), the wall panel is an expanded polystyrene sheet (EPS) panel.

13. The method of claim 12, wherein in step (d) and (h), the wall panels include a backing board cut to the outside dimensioning of the EPS sheet and mounted thereto, the backing board facing away from the vertical wall cavity during orientation and positioning of the panel onto the formwork.

14. The method of claim 13, wherein in step (d) and (h), the wall panels include T-shaped nailer components of a fixed length, width, and material thickness, the nailer components inserted into and through the wall panel via vertical slots placed strategically therethrough, the slots having a length slightly longer than the fixed length of the nailer component and a slot width the same as or slightly larger than the material thickness to form a snug fit when inserted.

15. The method of claim 1, wherein in step (e), the edge dam supports have a substantially right angle bend along one vertical edge forming a fin that extends outside of the vertical wall cavity area.

16. The method of claim 1, wherein in step (f), the center dam supports have a substantially right angle bend along opposing vertical edges and in the same direction forming fins that extend into the wall cavity area.

17. The method of claim 1, wherein the dam components and vertical supports are removable after the wall cavity is filled, and are reusable to dam another wall cavity along a wall being fabricated.

18. The method of claim 1, wherein in step (d) and (h), the wall panels include T-shaped nailer components of a fixed length, width, and material thickness, the nailer components inserted into and through the wall panel via vertical slots placed strategically therethrough, the slots having a length slightly longer than the fixed length of the nailer component and a slot width the same as or slightly larger than the material thickness to form a snug fit when inserted.

19. The method of claim 18, wherein the T-shaped nailer includes a vertical inner edge row and outer edge row of annular or oblong openings along the leading edge of the nailer, the openings of the inner edge row larger in size than the openings of the adjacent outer edge row, the outer edge row openings for retaining the nailer in the concrete after the wall cavity is filled and for preventing concrete from advancing into the EPS sheet during pouring.

20. The method of claim 19, wherein the T end of the nailer component provides a vertical mounting strip for secure attachment of external wall components or coverings.

* * * * *